US006609449B2

(12) United States Patent
Granger

(10) Patent No.: US 6,609,449 B2
(45) Date of Patent: Aug. 26, 2003

(54) AUTOMATIC DISPENSING APPARATUS FOR PAPER TOWELS AND TOILET PAPER

(76) Inventor: Maurice Granger, 17 rue Marcel Pagnol, St. Priest en Jarez 42270 (FR)

( * ) Notice: Subject to any disclaimer, the term of this patent is extended or adjusted under 35 U.S.C. 154(b) by 0 days.

(21) Appl. No.: 10/167,823

(22) Filed: Jun. 12, 2002

(65) Prior Publication Data

US 2002/0152870 A1 Oct. 24, 2002

Related U.S. Application Data

(63) Continuation of application No. 09/419,596, filed on Oct. 18, 1999, now Pat. No. 6,443,043, and a continuation of application No. 08/495,459, filed as application No. PCT/FR94/00116 on Jan. 31, 1994, now Pat. No. 5,979,284.

(30) Foreign Application Priority Data

| | | |
|---|---|---|
| Feb. 1, 1993 | (FR) | 93.01327 |
| Mar. 31, 1993 | (FR) | 93.04082 |
| Sep. 8, 1993 | (FR) | 93.11008 |
| Nov. 30, 1993 | (FR) | 93.14609 |

(51) Int. Cl.[7] ..... B26D 5/38; B26D 7/26; B26F 3/02

(52) U.S. Cl. ..... 83/649; 83/298; 83/334; 83/337; 83/650; 225/16; 225/39; 225/46; 225/51; 225/72; 225/106; 74/32

(58) Field of Search ..... 83/337, 648, 649, 83/650, 338, 334, 298, 314; 225/72, 96, 103, 106, 39, 42, 46, 51, 73, 74, 16; 74/32; 242/564, 565, 596, 562.1, 598, 598.2

(56) References Cited

U.S. PATENT DOCUMENTS

| | | | |
|---|---|---|---|
| 767,061 A | 8/1904 | Jonson | 74/32 |
| 1,220,064 A | 3/1917 | Bloom | 242/565 |
| 1,717,706 A | 6/1929 | Harris | 74/32 |

(List continued on next page.)

FOREIGN PATENT DOCUMENTS

| | | |
|---|---|---|
| DE | 4026969 | 3/1992 |
| EP | 0 317 448 | 5/1989 |
| EP | 0 469 461 | 2/1992 |
| GB | 714444 | 1/1952 |
| GB | 1486901 | 9/1977 |
| GB | 2185726 | 7/1987 |

*Primary Examiner*—Charles Goodman
(74) *Attorney, Agent, or Firm*—Wall Marjama & Bilinski LLP

(57) ABSTRACT

An automatic paper dispensing apparatus includes a molded plastic housing and a protective cover hingably attached to the housing, the housing further including a pair of parallel end shields disposed in a lower part of the housing. Each of said parallel end shields are perpendicular to a rear plane of the housing and spaced to allow positioning of a rotatably supported support drum and a pressure roller disposed in relation to the drum to ensure feeding of a strip of paper from a take-off reel disposed in an upper part of the housing. Each of the end shields include elastically deformable tongues having recesses to accommodate the pressure roller and to position opposing ends of the support drum, wherein the support drum is a unitary member comprising a smooth continuous area extending over essentially one-half the outer periphery of the drum, and having a plurality of discs spaced over the entire length thereof. Each of the discs are spaced apart from one another by a plurality of parallel plates, each of the discs including scalloped areas for accommodating a hinged cutting blade, the smooth area being disposed separately from the scalloped areas of the drum and in which the diameter of the drum at the smooth area is larger than the diameter of the drum at the remainder thereof so as to facilitate detachment of the strip of paper after cutting thereof.

1 Claim, 22 Drawing Sheets

U.S. PATENT DOCUMENTS

| | | | | |
|---|---|---|---|---|
| 2,139,339 | A | 12/1938 | Vaughan et al. | 225/16 |
| 2,288,332 | A | 6/1942 | Steiner et al. | 225/46 X |
| 2,303,520 | A | 12/1942 | Wilson | 225/46 X |
| 3,467,456 | A | 9/1969 | Chmela | 312/34.24 |
| 3,731,863 | A | 5/1973 | Nausedas | 225/51 X |
| 3,739,965 | A | 6/1973 | Jespersen et al. | 225/96 |
| 4,122,738 | A | 10/1978 | Granger | 83/337 X |
| 4,307,638 | A | 12/1981 | DeLuca et al. | 83/649 X |
| 4,611,768 | A | 9/1986 | Voss et al. | 242/564.2 |
| 4,635,837 | A | 1/1987 | Granger | 225/96 |
| 5,048,386 | A | 9/1991 | DeLuca et al. | 83/337 X |
| 5,146,830 | A | 9/1992 | Granger | 83/649 |
| 5,441,189 | A | 8/1995 | Formon et al. | 225/96 X |
| 5,526,973 | A | 6/1996 | Boone et al. | 225/39 X |
| 5,979,284 | A | 11/1999 | Granger | 83/649 |

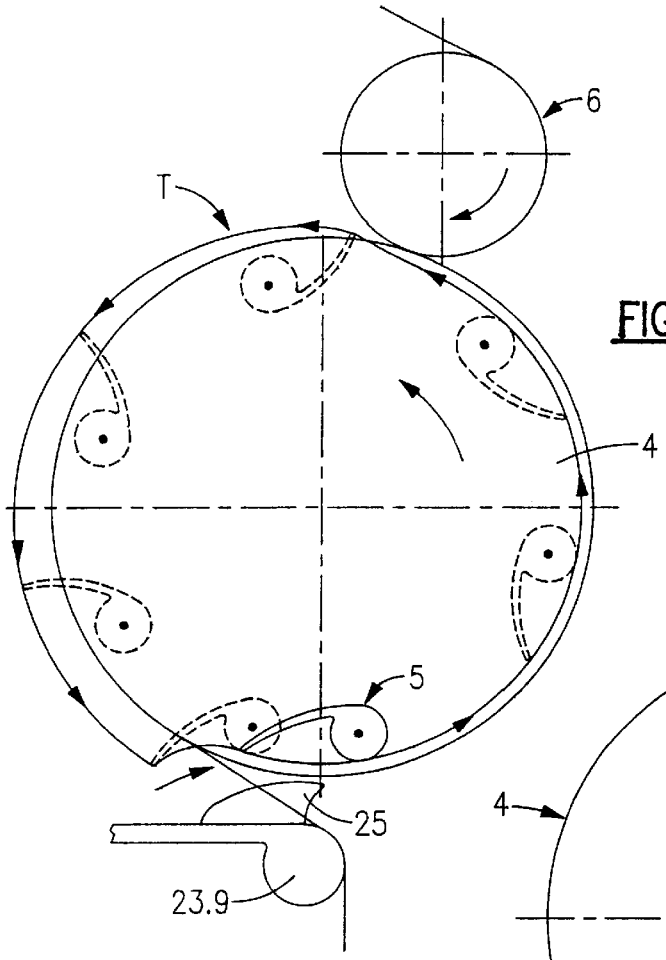
FIG.7
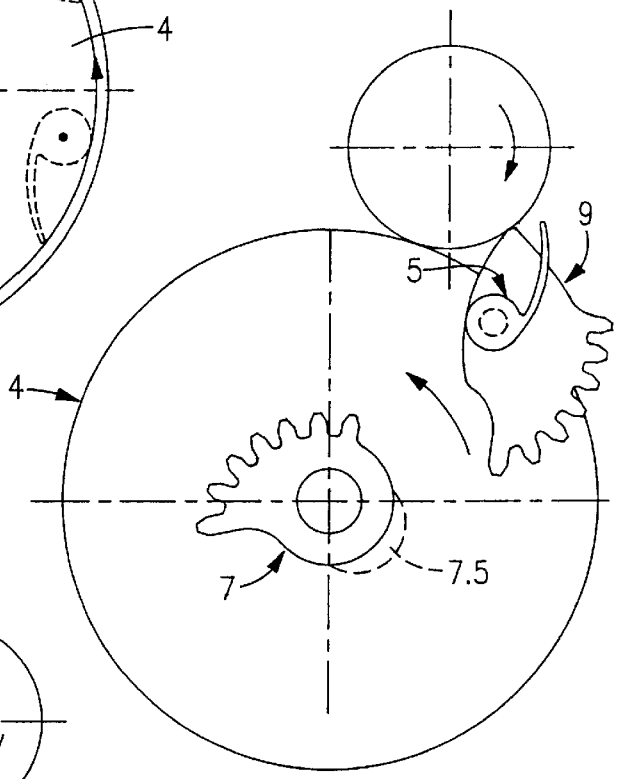
FIG.8
FIG.9
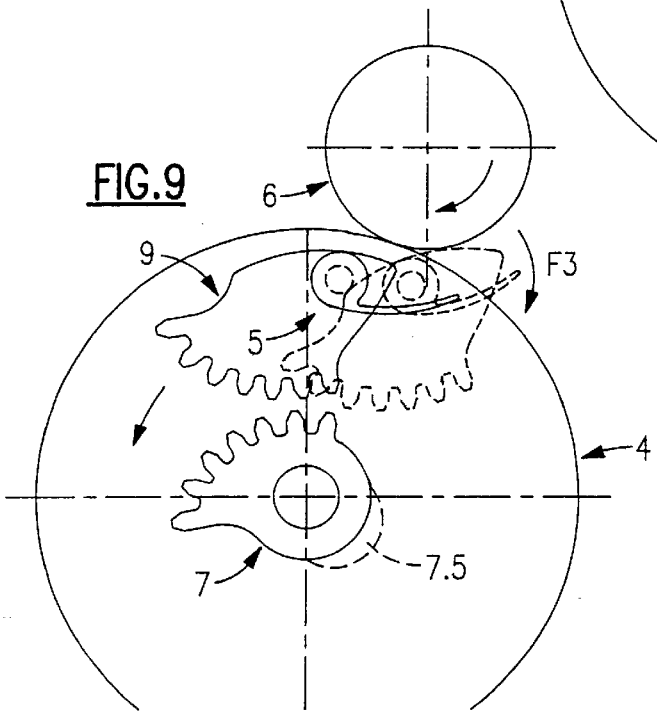

AUTOMATIC DISPENSING APPARATUS FOR PAPER TOWELS AND TOILET PAPER

CROSS REFERENCE TO RELATED APPLICATION

This is a continuation application of U.S. application Ser. No. 08/495,459, filed Jul. 28, 1995 now U.S. Pat. No. 5,979,284, Issued on Nov. 9, 1999, which is a 371 of PCT/FR94/00116, filed Jan. 31, 1994, and Ser. No. 09/419,596, filed Oct. 18, 1999 now U.S. Pat. No. 6,443,043, the entirety of which is incorporated herein by reference.

FIELD OF THE INVENTION

This invention relates to the technical sector of apparatuses dispensing cellulose wadding, creped paper towels and towels of similar materials, especially those intended for wiping the user's hands and toilet paper.

BACKGROUND OF THE INVENTION

There are a very large number of manual, semi-automatic and automatic dispensing apparatuses which perform the function mentioned above. The Applicant, in particular, has developed several apparatuses of this type with central unreeling, folding of the strip of material in accordion pleats and also as an automatic paper towel dispenser using a cutting device built into a drive drum. All these apparatuses are currently in use and operate very reliably. The cost price of these various apparatuses varies greatly depending on their construction and they are suited to different market segments.

As part of his own research, the Applicant is interested in designing a new automatic apparatus of which the architecture includes a reduced number of parts so that he can target the market for low-cost paper towel or toilet paper dispensing apparatuses.

SUMMARY OF THE INVENTION

One object sought after according to the invention was to design an apparatus devised so that its various components can be assembled manually in a quick, simple manner without requiring any non-standard tools.

Another object sought after according to the invention was to design an apparatus in which the various components are, once fitted, self-locking and suitable for dispensing paper regardless of the tension stresses produced when the user pulls the paper.

Another object sought after according to the invention was to ensure the locking of the components of the apparatus in position by making use of the elasticity of certain fixed parts formed on the support housing and cover.

Another object sought after according to the invention was to produce an apparatus that can be quickly assembled or disassembled by an operator and that also allows the characteristics of the drum and cutting device to be altered if necessary without modifying the structure of the apparatus.

These objects and others will become apparent from the following description.

According to a first aspect, the automatic dispensing apparatus for material paper towels or toilet paper is distinctive in that it comprises a molded housing made of plastic of which the upper part contains a take-off reel of paper towels or toilet paper, a cutting-blade holder having a hinged cutting blade, a support drum and a tensioning device that ensures feeding of the paper band to the drum and tensioning of the paper, the hinged cutting blade in the drum being moved by cooperation of a toothed heel associated with the shaft of the cutting blade holder and cooperating with a rack device internally fixed on one of the sides of the housing, the drum being associated with a start mechanism, a protective cover hinged relative to the housing and clicking onto the latter, and in that the protective housing is devised with parallel flanges that are perpendicular to the rear plane of the housing in the paper towel version or between a front flange and the rear wall of the housing in the toilet paper dispensing version in order to allow the drum and tensioning device to be fitted by clicking them in, said flanges or rear walls of the apparatus being made with tongues capable of elastic deformation due to preformed elasticity slits on the flanges and/or rear wall of the apparatus, said tongues having recesses to accommodate the tensioning device and the flanges and/or rear wall of the housing and the front flange also having scalloping to position the ends of the drum shaft.

According to another aspect, the various recesses for the ends of the shafts of the tensioning device of the drum face opposite each other and in that the tongues that receive the tensioning device press, by elasticity, the tensioning device against the drum and ensure that the tensioning device of the drum locks itself into position in the housing of the apparatus and in that unobstructed access to the areas for positioning the tensioning device and the drum is obtained through cutouts made on the front of said tongues and flanges allowing quick assembly of the apparatus components.

According to another aspect, the one-piece drum comprises a shaft around which there is, over part or all of its circular periphery, a plurality of adjacent parallel discs comprising intermediate discs of the same configuration used to press the pulled paper band and having scalloping around their periphery in order to position and accommodate the cutting blade in the idle position, said shaft accommodating a first front end disc and a second rear end disc making it possible to position and hinge the cutting blade and in that the rear end disc is equipped with a means defining an internal chamber to accommodate a rack device that adapts to a fixed position on the opposite side of the housing and in that the blade holder is devised with one end opposite the means with a heel-shaped part comprising a plurality of teeth forming a matching rack device capable of cooperating, when the drum rotates, with a plurality of teeth constituting a fixed rack device formed on the means and in that a limit stop ensures, after partial rotation of the drum with a view to cutting the paper band, re-engagement of said cutting blade along a trajectory opposite to the direction of rotation of the drum into the scalloping formed on the latter during the additional rotation of the drum with a view to presenting it for a new operating cycle, and in that rotation of the drum is obtained by means of a tensioning device that feeds the paper band towards the drum and it is tensioned by the user pulling on the end of the paper band.

According to another aspect, the protective cover comprises means in the form of lugs that are capable of pressing against the tongues that receive the tensioning device and/or against the flanges of the housing that accommodates the drum and/or against the tongues and against said flanges.

These aspects and others will become apparent from the following description.

BRIEF DESCRIPTION OF THE DRAWINGS

The object of the present invention is described, merely by way of example, in the accompanying drawings in which:

FIG. 7 is a schematic view showing the trajectory of the cutting-blade holder in one rotation cycle of the drum, FIGS. 8 and 9 are schematic views showing a means of controlling the position of the blade holder in the drum depending on the operating cycle, FIG. 10 schematically shows the position in which the cutting blades attack the paper.

DETAILED DESCRIPTION

In order that the present invention may more readily be understood, the following description is given, merely by way of example, with reference being made to the accompanying drawings.

The apparatus according to the invention is suitable for automatically dispensing and cutting wipes made of any appropriate materials, cellulose wadding, creped paper or similar materials intended mainly for wiping the hands, or for the dispensing of toilet paper.

The two versions (paper towel, toilet paper) are shown, the main components of the apparatus remaining the same. Only their positioning inside the protective housing and the cover changes, as is apparent from the drawings and from the description.

As stated earlier, one of the objects sought after according to the invention was to design a layout of the structure of the housing that accommodates the components allowing quick assembly, easy access, reliable and completely safe operation without using any special tool to carry out such assembly or disassembly.

In addition, as will be apparent from the rest of the description, the features and means used make it possible to achieve self-locking of the various components of the apparatus in a simple, quick manner without using any special mechanical means.

The apparatus is initially described, reference being made to the main characteristics of the dispensing apparatus according to the invention, before describing the various applications of its components and its special features.

Figure 1:
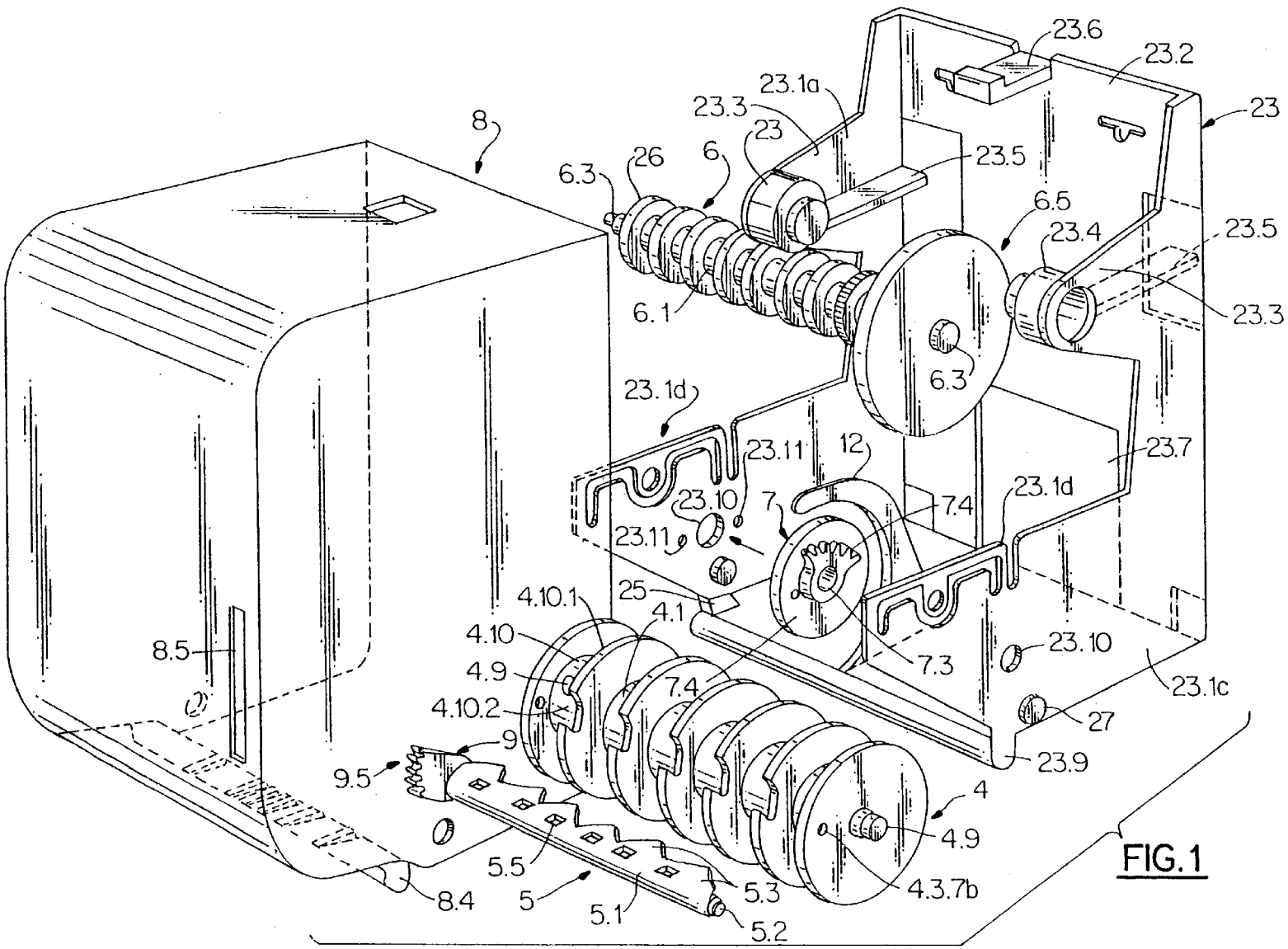
FIG. 1 is an exploded perspective view, before assembly, of a apparatus in a first application of the invention.
Figure 2:
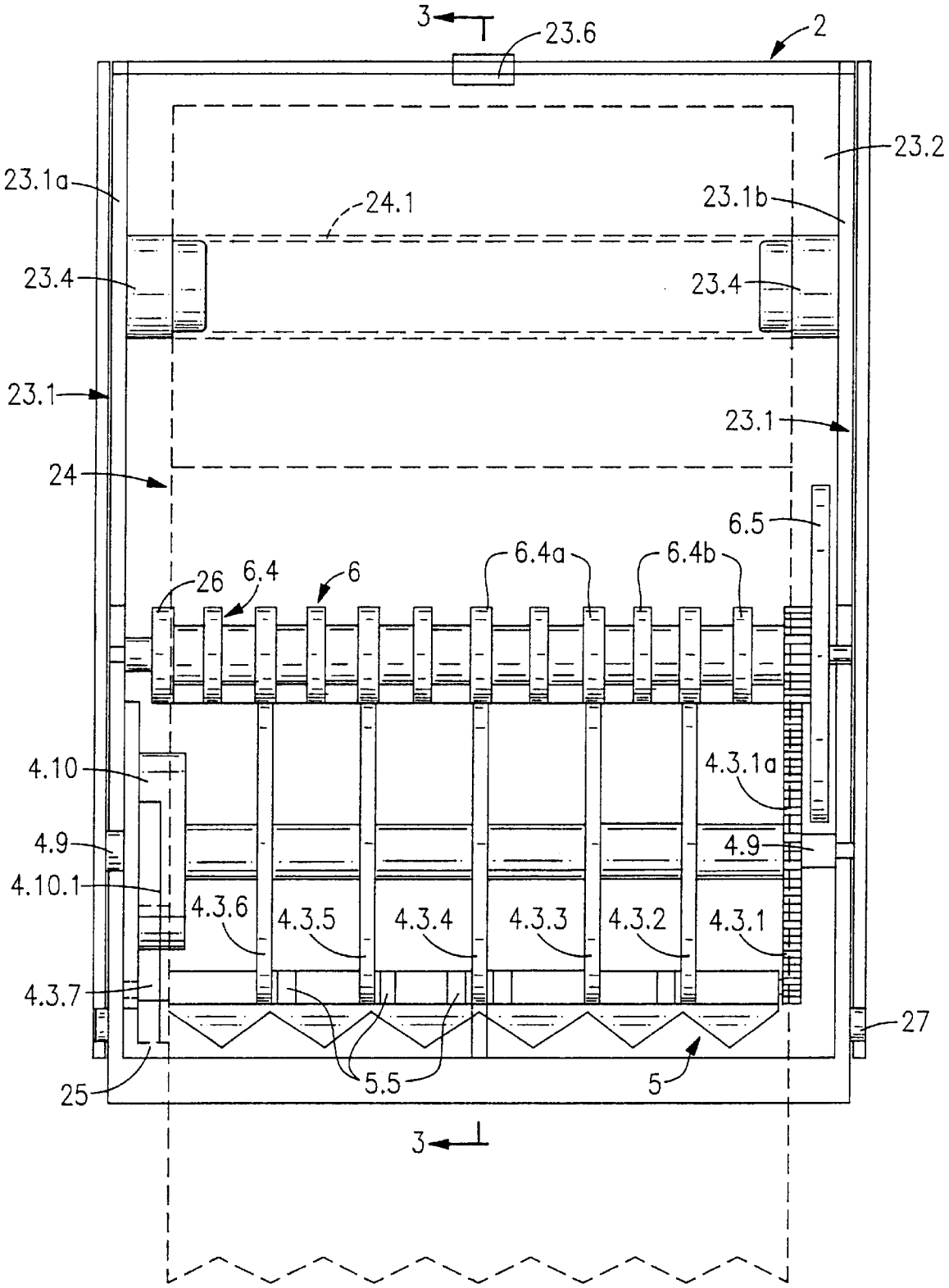
FIG. 2 is a front view of the apparatus according to FIG. 1 after assembly, with the protective cover having been removed and in a non-operating phase.
Figure 25:
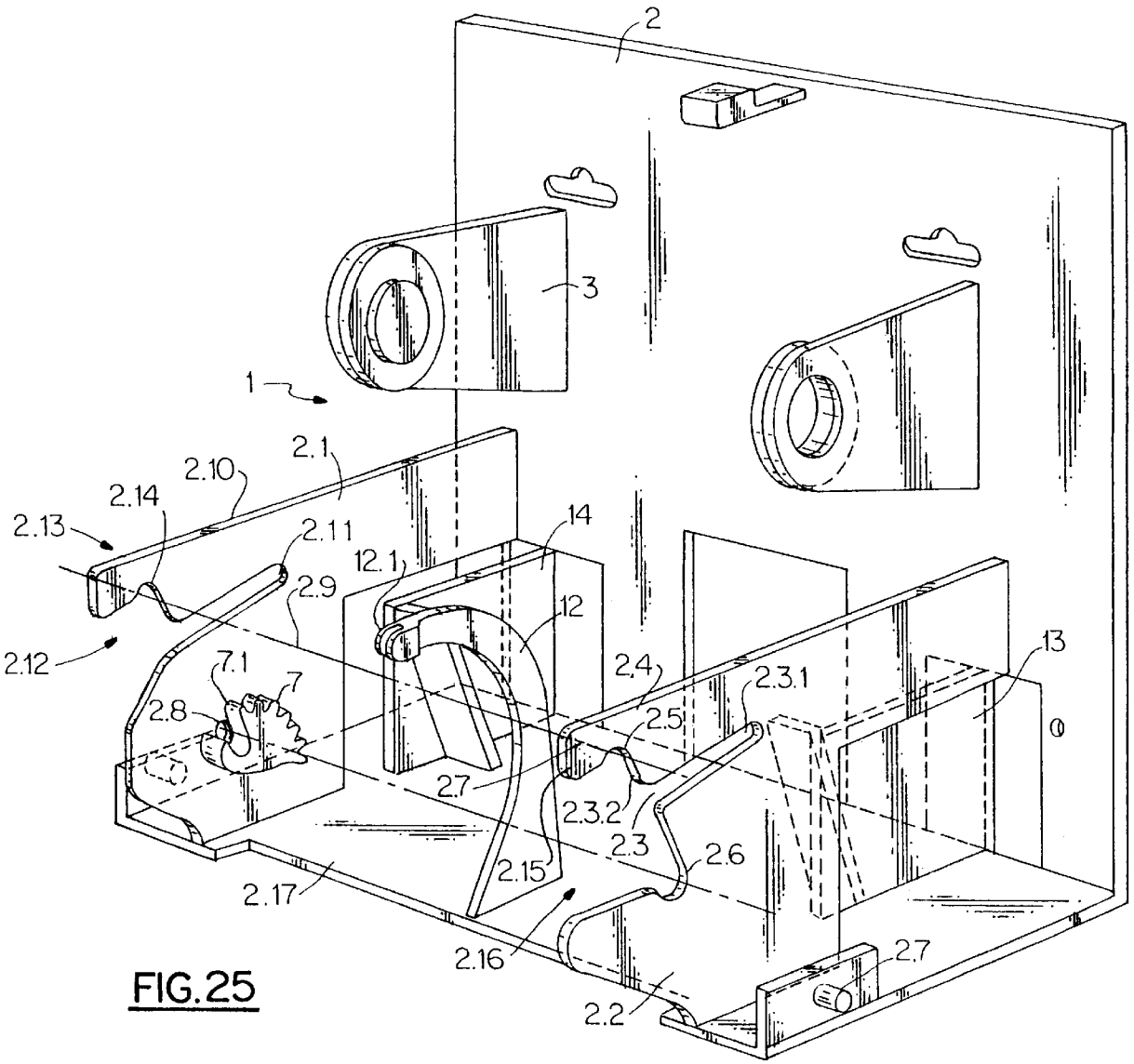
FIG. 25 is a three-quarter perspective view of the frame structure of the apparatus before assembly of the components that can be used.
Figure 26:
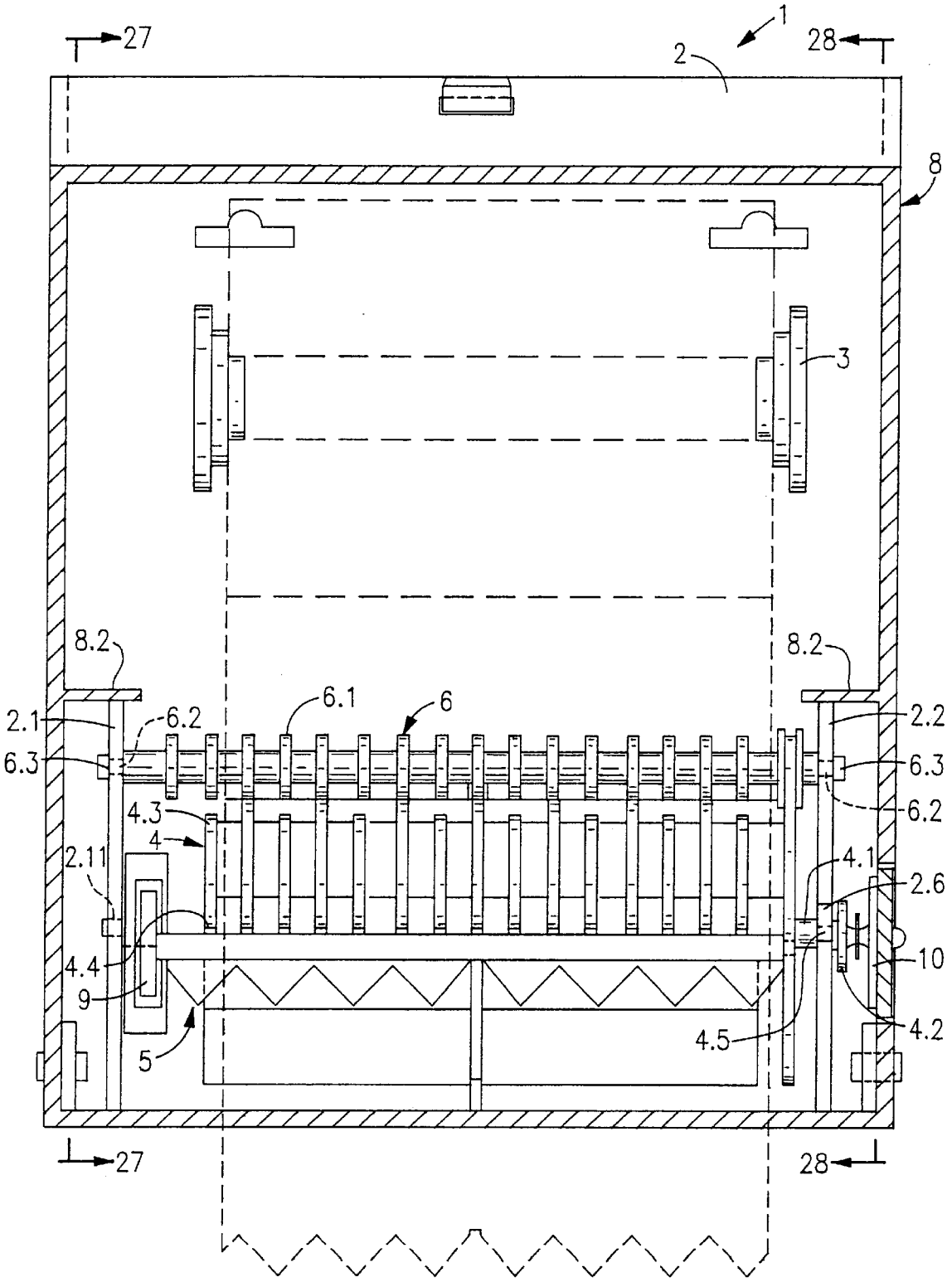
FIG. 26 is a front view of the apparatus along section E—E in FIG. 27 after its components have been assembled, namely the material reel holder, the drum that accommodates a paper cutoff device and the material tensioning device that presses it against the drum.
Figure 27:
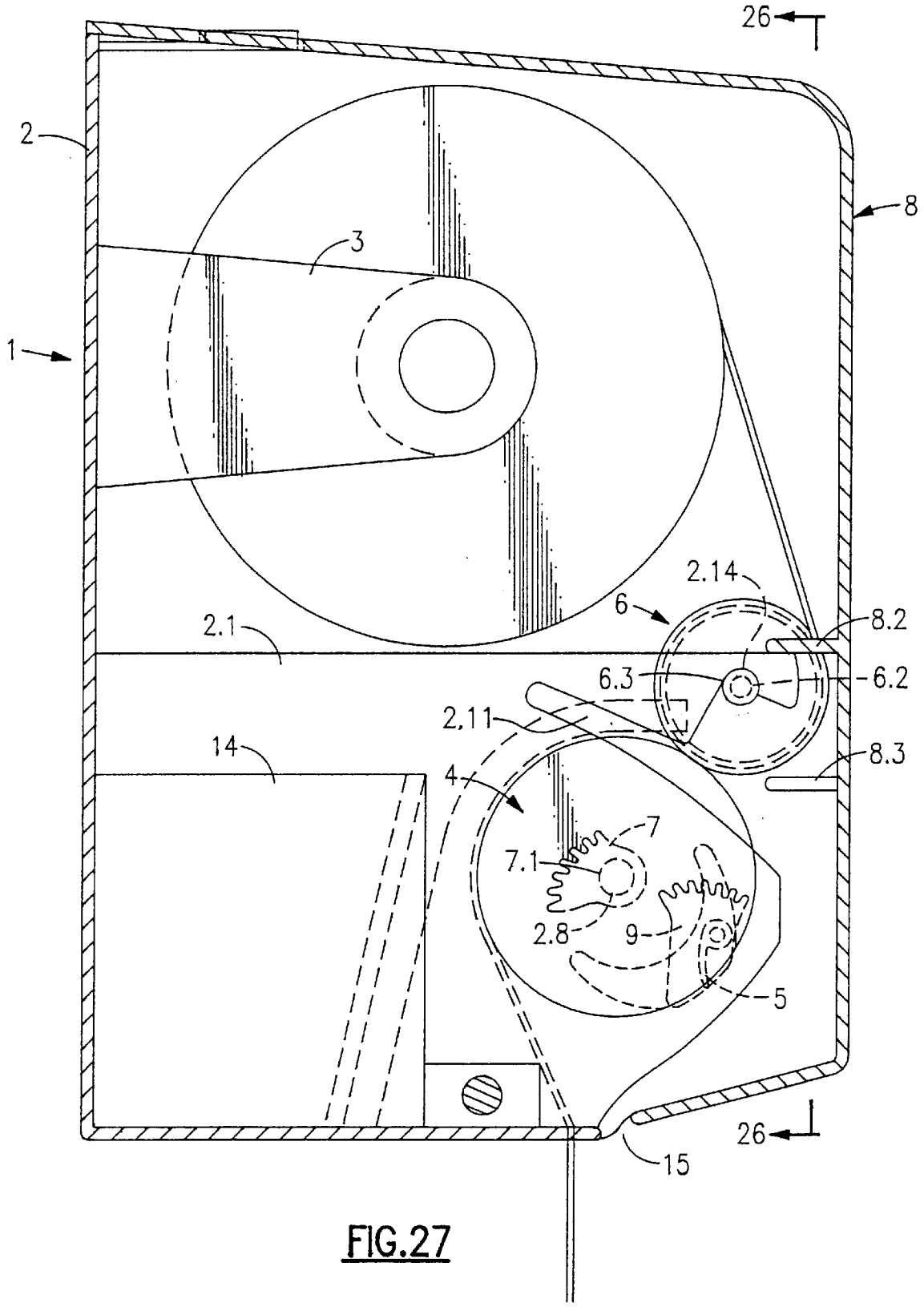
FIG. 27 is a side view along line F—F in FIG. 26.

The dispensing apparatus for paper towels or toilet paper is devised to operate automatically. Referring briefly to FIGS. 25 and 26, the apparatus is referred to in its entirety as (1). It comprises six parts that make up all the components and mechanisms needed for it to operate. The apparatus (1) firstly comprises a molded plastic housing (2) capable of accommodating, in its upper part, a paper towel or toilet paper take-off reel in a reel holder (3), a drum (4), a blade holder (5), and a tensioning device (6) for ensuring, on the one hand, feeding of the paper band to the drum (4) and, on the other hand, tensioning of the paper. The displacement movements of the blade holder towards the drum (4) in order to cut the paper are obtained by a rack device (7) in a fixed internal position on one of the flanges (2.1) of housing (2). The blade holder (5) (or variously "cutting blade holder" or "blade" or "cutting blade") can be moved by the mechanisms and means described in the rest of the description. Protective cover (8) protects the above-mentioned mechanisms and the reel of paper band that is to be dispensed. Referring to FIG. 1, the protective cover (8) is positioned and hinged at the base of a similar housing (2) of the apparatus (1) and is fixed by clicking it onto the housing by means of a locking tongue (23.6) situated in the upper part of the housing (23).

The drum (4) comprises a shaft (4.1) of small diameter over which there is a plurality of adjacent, parallel discs (4.3), each of the discs having shaped scalloping (4.4) capable of forming a recess for accommodating the blade holder (5). Rack device (7) located in a fixed internal position against one of the flanges (2.1) of the housing (2) as an extension of the axis of the drum (4) cooperates with a heel-shaped part (9) having a plurality of teeth associated with the axis of the cutting blade (5), this heel-shaped part (9) cooperating with the rack device (7) and defining movements to extend the blade holder (5) out of the drum (5) under the conditions described in the rest of the description.

Figure 29:
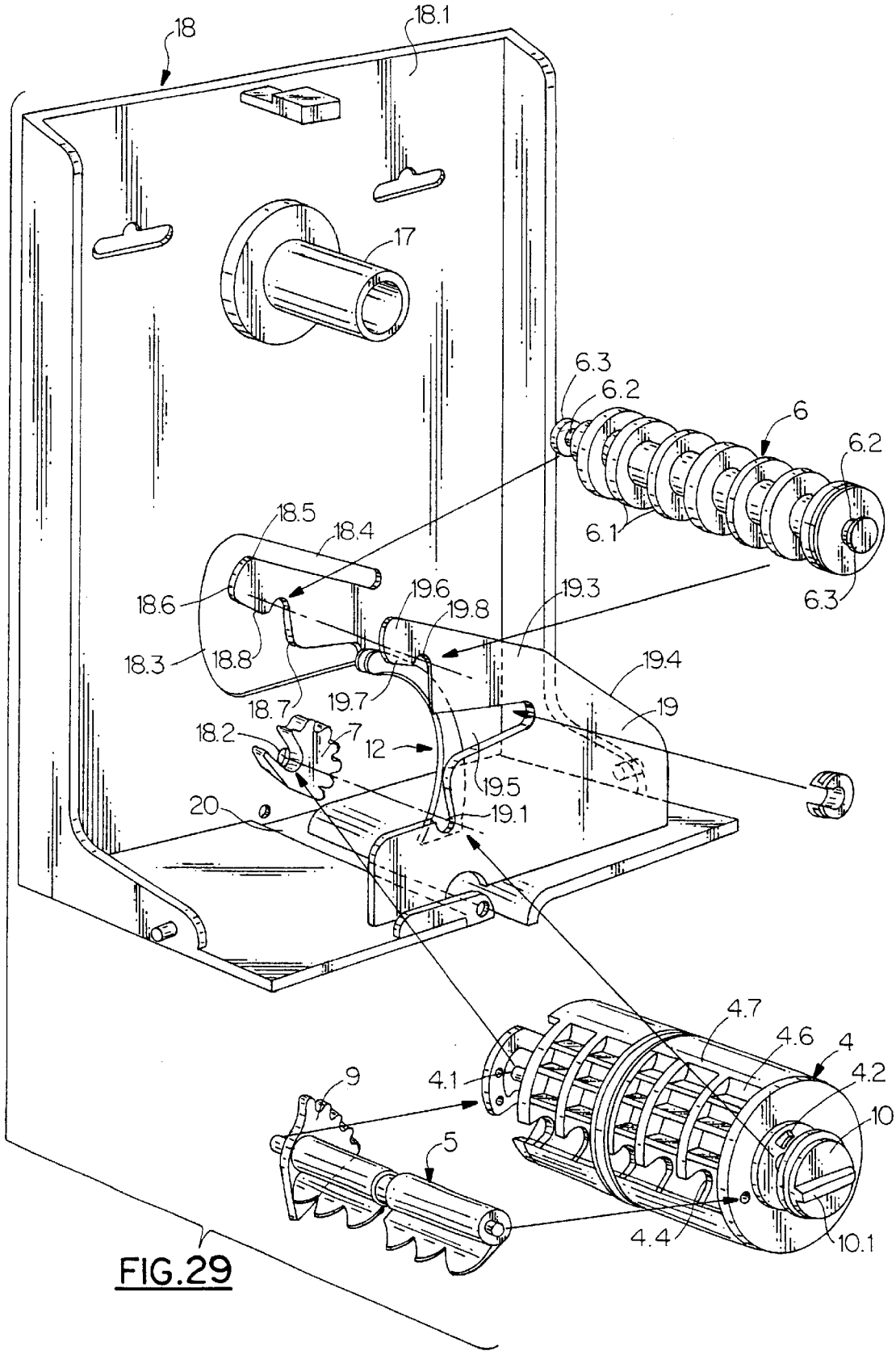
FIG. 29 is a perspective view before assembly of the apparatus in its application for dispensing toilet paper.
Figure 30:
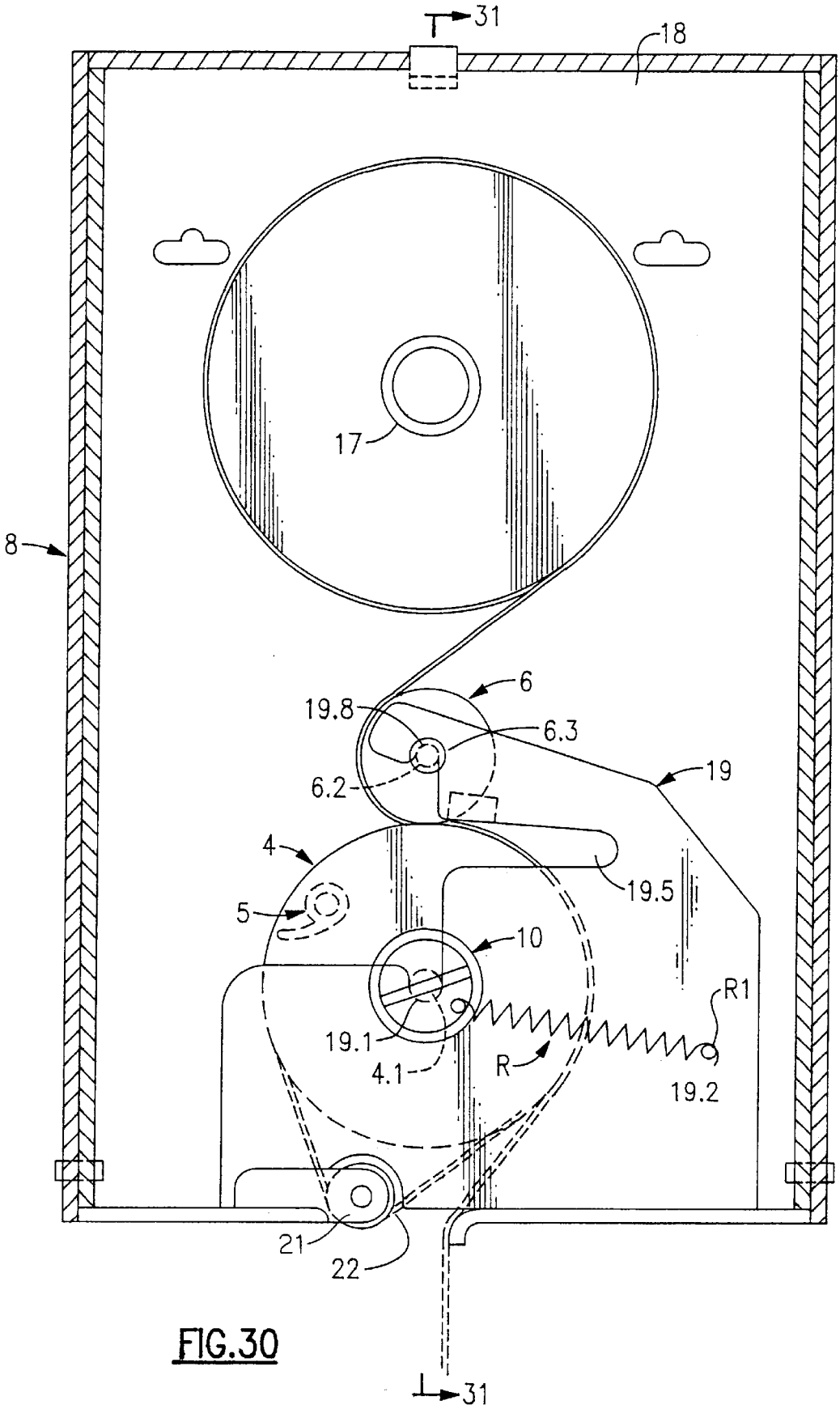
FIG. 30 is a cross-sectional front view along line H—H in FIG. 31.

The cutting blade holder (5) is centered in the scalloping (4.4) or recesses formed between one of the end flanges of the drum and between a part forming a throat (4.5) placed at the other end of the drum (4) opposite rack device (7). The drum (4) may be devised with a solid external part, for example, in the shape of a radius whereas the discs (4.3) of the above-mentioned type remain exposed over the second half part of the drum. The drum (4) may have, on its exposed parts, gripping areas to allow good retention and transport of the paper band. The drum (4) forms a one-piece assembly. In an alternative embodiment, the drum (4) may have a honeycomb structure (4.6), such as shown in FIG. 29, with no central connecting shaft but, at its ends, shafts to maintain it in position between the flanges. This honeycomb structure (4.6) may be established over all or part of the volume of the drum (4), preferably with, over a radius, a solid form (4.7) facilitating the feed and transport of the material. A drum (4) of this kind has the advantage of being made of plastic that is very easy to mold whilst nevertheless being rigid and light.

On the side opposite rack device (7), the drum (4) extends beyond its end disc as a shaft (4.2) with an eccentric lever (28) used to position a drum tensioning and return spring (R), this assembly being molded onto said drum.

Tensioning device (6) presses against the drum (4) and, in particular, against the end and intermediate discs and also has, over its entire length, a plurality of discs (6.1) that press against the corresponding parts of the drum (4). Tensioning device (6) is centrally aligned and hinged between the lateral flanges (2.1, 2.2) formed on the housing (2). Tensioning device (6) is also a one-piece element.

Having defined the main arrangements and components of the dispensing apparatus (1), the special characteristics of the housing are now described which make it possible to position the various components, allowing optimum access, by manual assembly without using special tools or mechanical means, reference being made to FIGS. 25 to 32.

Reference is first made, according to the invention, to the dispensing apparatus as used to dispense paper towels where the paper is pulled by the user from the front.

As stated earlier, drum (4) and tensioning device (6) are positioned between flanges (2.1, 2.2) of the housing (2). Each of these flanges (2.1, 2.2) is formed in a very special way to allow mounting of the drum (4) and the tensioning device (6) by clicking them in and making use of the elasticity of said flanges. In addition, these flanges (2.1, 2.2) are devised with shapes that allow self-locking of the drum (4) and the tensioning device (6) after assembly.

For this purpose, viewed from the front of the apparatus, FIG. 25, right-hand lateral flange (2.2), situated on the side of the mechanism to actuate the drum (4) is devised with a T-shaped slanting cutout (2.3), the downstroke (2.3.1) of the T-shaped slanting cutout being raised upwards and towards the rear of the flange and being long. A first end of the crossbar (2.3.2) of the T-shaped slanting cutout penetrates the upper part of the flange (2.2) to define tongue recess (2.5) while the length of the downstroke defines a tongue (2.4) forming a hook. The upper and lower ends of the crossbar (2.3.2) of the T-shaped slanting cutout define rounded internal recesses (2.5, 2.6) used to position one of the ends of the tensioning device (6). The lower part of the crossbar (2.3.2) of the T-shaped slanting cutout forms a recess for one of the ends of the shaft (4.1) of the drum (4), FIG. 26. The front part of the flange (2.2) is cut away at (2.16) to allow access, clearance and mounting of a tensioning device (6) and drum (4). The downstroke (2.3.1) of the T-shaped slanting cutout (2.3) is used to define and give the upper tongue (2.4) a certain degree of elastic mounting in order to insert tensioning device (6) and drum (4). The upper tongue (2.4) forms a hook (2.7) at its end with an access ramp to the scalloped area (2.6) that receives the shaft of tensioning device (6).

Still referring to FIG. 25 the other or left-hand flange (2.1), as viewed from the front, has a portion that accommodates the rack device (7) with an opening (2.8) as clearance for one of the shafts of the drum (4), FIG. 26. The rack device (7) surrounds said opening (2.8). The flange (2.1) thus has a solid part (2.9) that extends upwards as a separate tongue (2.10) by a slit (2.11) giving said tongue a certain degree of elasticity. Above-mentioned slit (2.11) is situated in exactly the same plane and at the same angle as downstroke (2.3.1) of the T-shaped slanting cutout (2.3) made on the other flange. Flange (2.1) has a front cutout (2.12) allowing access to slit (2.11) defining the tongue (2.10), whereas the tongue is made in a manner similar to the one above having a hook shape (2.13) with a tongue recess (2.14) making it possible to fit the other end of the tensioning device (6). The recesses (2.5, 2.14) formed on the tongues (2.4, 2.10) may, if applicable, accommodate additional means to ensure satisfactory retention of the ends of the tensioning device and, above all, avoid any damage or wear of the bottom part of the flanges (2.1, 2.2) when the tensioning device (6) is actuated.

Referring to FIGS. 25 and 26, said ends of the tensioning device (6) are each devised with a throat (6.2) that is inserted in said recesses (2.5, 2.14), whereas the end of the shaft of the tensioning device (6) has fingers (6.3) on opposite ends thereof that are capable of pressing against the external walls of the flanges (2.1, 2.2) and the tongues (2.10, 2.4) in particular.

The components are assembled as follows. The first end of the drum (4) on the toothed heel side is positioned so that its shaft penetrates into rack device (7) fixed on the interior side of flange (2.1). Said rack device (7) therefore forms a bearing surface that accommodates and guides the drum shaft. The rack device (7) includes a cutout (7.1) to enable and facilitate the positioning or removal of the shaft of the drum (4). The other end of the shaft of the drum (4) has a throat (4.5) situated in front of eccentric lever (4.8), said throat being inserted in the lower recess (2.6) made on the flange (2.2). Tensioning device (6) is then positioned. The tensioning device (6) is also put in and positioned through the front of the apparatus (1). At the start of assembly, the tensioning device (6) rests against the drum (4) and throats (6.2) form ramps of the hook parts of the tongues (2.14, 2.4). Pushing tensioning device (6) backwards by hand causes slight lifting of the tongues (2.10, 2.4), due to their elasticity due to the slanting slits (2.3, 2.11). Pushing tensioning device (6) backwards simultaneously causes slight backward rotation of the drum (4), then tensioning device (6) clicks into the upper recesses (2.14, 2.5) formed on the hook part of the tongues.

Due to elasticity, said tongues (2.10, 2.4) keep tensioning device (6) firmly pressed against the drum (4), the various discs (6.1) of the tensioning device (6) being in contact with the corresponding opposite parts of the drum (4). The various recesses that receive the shafts of the tensioning device of the drum (4) are opposite each other.

Assembly is therefore simple, quick, effective and provides easy access. Disassembly is performed easily by manually releasing one of the ends of the tensioning device (6) from the corresponding tongue.

Figure 28:
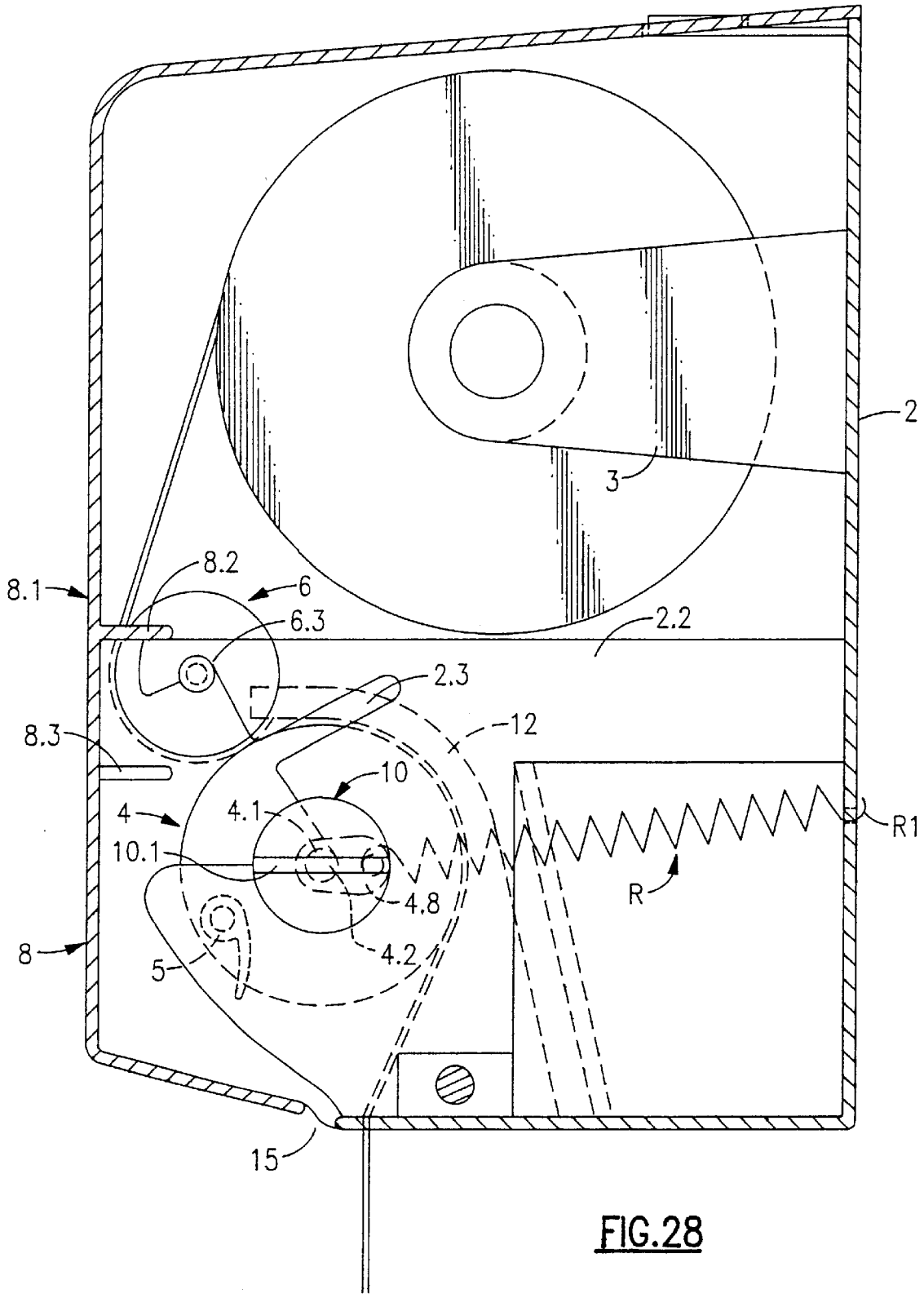
FIG. 28 is a side view along line G—G in FIG. 26.

Beyond its eccentric lever, the shaft (4.2) of the drum (4) has a throat (4.5) used to fasten return spring (R) of which the other end (R1) is fixed to the rear wall of the housing (2) as shown in FIG. 28. This throat (4.5) extends as a one-piece feature as a disc-shaped profile (10) with a central rib (10.1), this assembly constituting an operating button in order to load the apparatus.

One end of a gooseneck-shaped bow (12) has a fork-joint (12.1) that fits around one of the upper discs of tensioning device (6) in order to control guiding of the paper band. A storage area (13) for the reel of material which has nearly been used up and for storing the mandrel is provided behind the gooseneck bow (12). Lateral flanges (14), directly molded onto the housing (2), therefore define the area that accommodates the reels of wipe material at the end of dispensing.

A special layout of the cover (8) of the apparatus (1) is provided in order to complete the assembly, safety and locking of the various components.

In particular, as shown in the drawings, the front panel (8.1) of the cover (8) has at least two horizontal lugs (8.2) that are capable of pressing, when the cover is closed, against certain parts of flanges (2.1, 2.2) of parts of the housing (2) and, in particular, tongues (2.10, 2.4) that accommodate the tensioning device (6). In this way, these lugs (8.2) ensure the tongues (2.4, 2.10) are securely held in position and make it possible to absorb any tension resulting from pulling of the paper band by the user. These lugs (8.2) can be arranged either so that they rest against the upper parts of the tongues (2.4, 2.10), or against the lower faces of the flanges (2.1, 2.2) in the areas that accommodate the drum (4) as shown in the drawings, or four lugs placed on the various above-mentioned parts are provided. This achieves extremely effective and reliable locking in position. Opening the cover (8) releases said tongues (2.4, 2.10) and one can, as stated above, release the tensioning device (6) and then the drum (4).

The material is loaded as before. The upper reel holder (3) fitted in the upper part of the apparatus (1) delivers a strip of material. To load the apparatus, the operator allows the strip of material to fall through the front of the apparatus and then closes the cover (8). This ensures additional locking of the various components. A horizontal lug (8.3) formed on the cover (8) makes it possible to then thread the paper between the tensioning device (6) and the drum (4). The operator presses button (10) against the elastic return spring (R). The end of the paper band then moves as it is driven by the tensioning device (6) of the drum (4), behind the latter and then emerges into the lower part of the apparatus (1). A slit (15), FIG. 27, that is known in itself is therefore formed underneath the horizontal bottom plate (2.17) of the housing (2) in order to remove the paper. The apparatus (1) is ready for operation.

As is apparent from the description, this assembly is of an extremely simple design. It is very easy to assemble the components, drum (4) and tensioning device (6), with the drum having previously been fitted with its associated cutting blade holder (5).

The structure of the housing of the apparatus in the toilet paper dispensing version as shown in FIGS. 29 to 32 is now described.

The drum (4) and blade holder (5) components as well as tensioning device (6) remain the same, as do the mechanism for loading the apparatus with material including, from the drum (4), an eccentric shape extending as an operating button (10) and a return spring (R) which is fastened by one of its ends.

In the case of the toilet paper dispensing apparatus, the reel of material is unwound in a plane that is perpendicular with respect to the rear mounting plane of the apparatus. The upper part of this rear mounting plane accommodates a mandrel (17) that holds the reel of material.

In order to ensure positioning of the drum and its associated paper cutoff device as well as the tensioning device under the same conditions as above, housing (18) is devised with, on the other hand, on its rear panel (18.1) and, on the other hand, on its front part, a separately mounted front flange (19), the rear panel and the mounted front flange being devised with shapes and cutouts making it possible to position drum (4) and tensioning device (6).

The internal rear panel (18.1) of the housing (18) has an opening (18.2) with a rack device (7) capable of accommodating the end of the shaft of the drum (4) under the conditions mentioned earlier. Above it, the rear panel (18.1) of the housing (18) has a U-shaped cutout (18.3) with convergent legs (18.4) defining the shape of a tongue (18.5) capable of a certain degree of elastic deformation. The front part of this tongue (18.5) forms a head or hook (18.6) with a slit or recess (18.7) for one of the ends of the tensioning device (6). The adjacent part of the recess (18.7) forms a ramp (18.8) to allow insertion, by elasticity, of the tensioning device in order to position the throat (6.2) formed on said device in said recess. On the other side and at the front, the front flange (19) is arranged widthways across the apparatus parallel to the rear mounting plane. The lower part of the front flange (19) has an opening (19.1) forming a recess used to position the shaft of the drum opposite the throat formed between the last disc and the eccentric part. The rear part of the front flange (19) has an anchoring stud (19.2), FIG. 30, for one of the ends of return spring (R) of the drum. The top upper part of the front flange (19) is devised with a tongue (19.3) that almost identically matches that formed on the rear wall (18.1) of the housing (18). These tongues (19.3, 18.5) are thus in the same plane and have the same inclination. The tongue (19.3) formed on the front flange (19) is linked to the latter by its rear part (19.4) whereas an intermediate slit (19.5) gives the tongue its desired elasticity. The front part of the tongue (19.3) forms a hook (19.6) with a ramp (19.7) for accessing a recess (19.8) or scalloping used to position the other end of the tensioning device (6) at the level of its above-mentioned throat. The shoulder-shaped ends of the tensioning device (6) rest against the external parts of the rear panel (18.1) of the housing (18) and the tongue associated with the front flange (19). The drum (4) and its associated paper cutoff device, as well as the tensioning device (6), are assembled in the manner described above for the paper towel apparatus. The drum (4) is of the type described with a plurality of discs over half the cylinder and then extends as a solid shape accommodating an area for gripping the paper band. The tensioning device (6) is devised with a plurality of discs (6.1) capable of resting against the corresponding shapes on the drum (4).

As states previously, the tensioning device (6) is clicked into the cutouts formed on the tongues in opposition to the elastic deformation of the latter. Through an elastic return force, said tongues (18.5, 19.3) contribute towards maintaining the tensioning device (6) against the drum (4).

Also, the housing (18) is additionally devised with a gooseneck-shaped bow (12). The end of this bow (12) has a fork-joint (12.1) that fits around the disc opposite the tensioning device (6). A storage receptacle area (13) for reels at the end of the cycle limited by the rear wall of the receptacle is provided behind the bow (12), the internal face of the flange, the actual bow itself and a return angle. Underneath the drum (4), the housing (18) has a horizontal bottom plate with a cutout or slit (20) allowing clearance for and dispensing of the paper.

Figure 31:
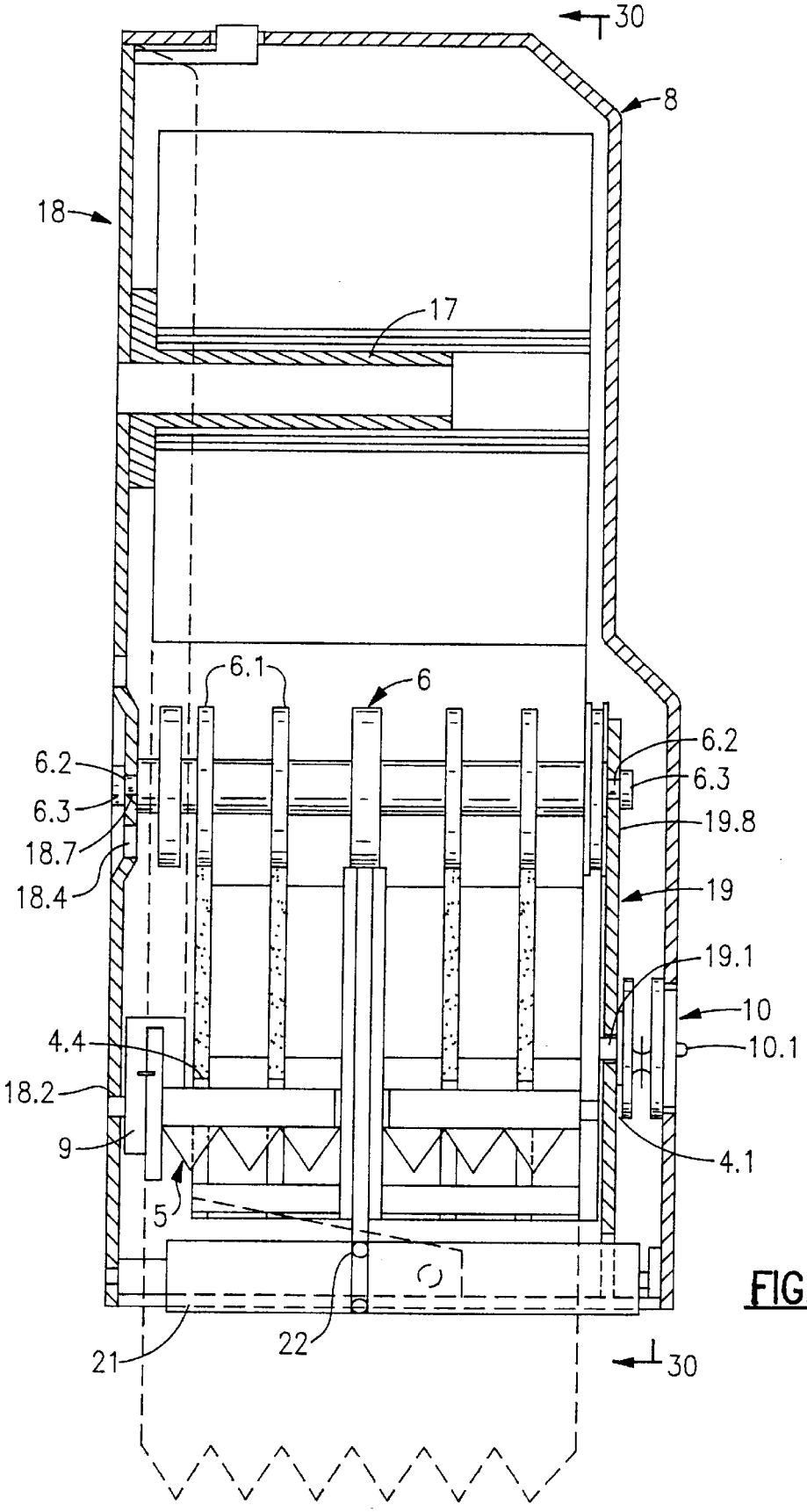
FIG. 31 is a cross-sectional view along line I—I in FIG. 30.
Figure 32:
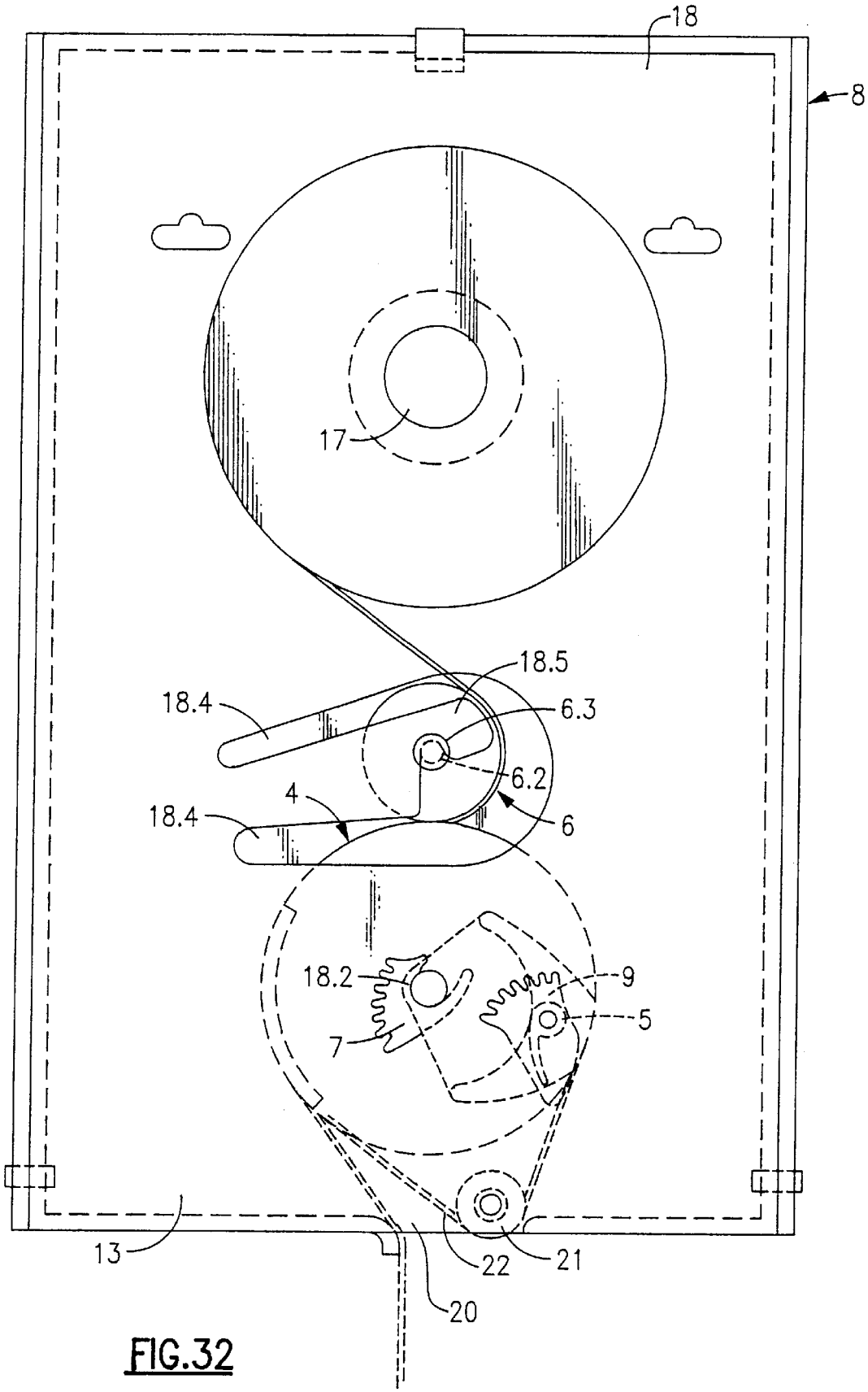
FIG. 32 is a rear view of the apparatus according to FIG. 29.

Between the above-mentioned slit (20) and the drum (4), a roller (21), FIG. 31, preventing the pulled paper from re-entering the apparatus, is ideally located in a known manner. The drum (4) and the roller (21) underneath are associated with each other by a paper guide or transmission belt (22) at the outlet of the apparatus. This roller (21) is conveniently held between the rear (18.1) panel of the housing (18) and a linking lug placed at the front of the apparatus and connected to the horizontal support plate of the latter. The front flange (19) has a rounded cutout allowing clearance for said shaft.

The components of the apparatus are now described in more detail in various applications and alternative embodiments according to FIGS. 1 to 24 without going beyond the concept of the invention as previously described.

Figure 3:
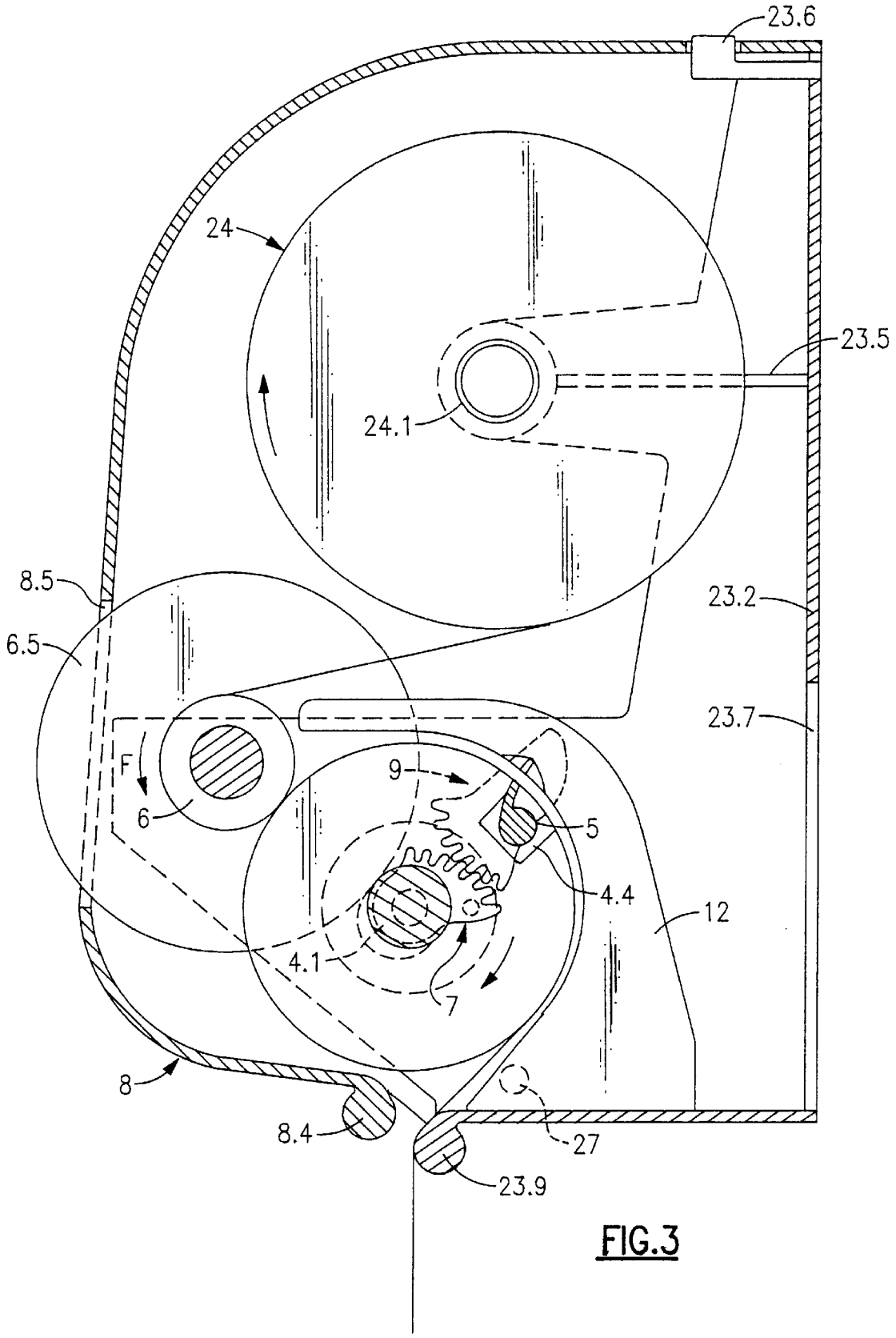
FIG. 3 is a transverse cross-sectional view along line 2—2 in FIG. 2, FIG. 4, 5 and 6 are large-scale views showing the various phases of positioning the rack device associated with the cutting blade relative to the fixed-position rack device built into the drive drum.
Figure 4:
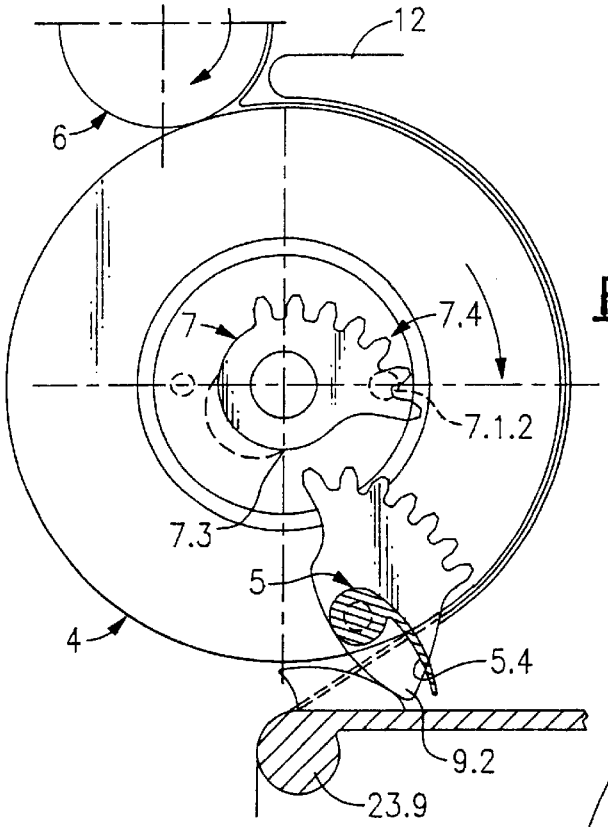

The housing (23) is made as a plastic one-piece unit and comprises a plate (23.2) having lateral sides (23.1*a*, 23.1*b*) shaped so that their upper part forms triangulated projections (23.3) opposite each other and directly molded-on cylindrical end fittings (23.4) allowing mounting of the reel of material (24), FIG. 3. The latter comprises, in a known manner, an internal cylinder or sleeve (24.1) of which the ends are capable of fitting into said freely mounted end fittings. Said sides are slightly flexible to allow mounting of the reel (24). Reinforcing ribs (23.5) formed between the end fittings (23.4) and the plate (23.2) of the housing (23) are also provided, these ribs making it possible to preserve and maintain correct positioning of the turns of the reel relative to each other. The upper part of the plate (23.2) has a shaped hook (23.6) or equivalent means intended to click onto the cover (8) in order to ensure closing of the assembly, the latter being supplemented by any additional locking means if necessary.

Advantageously, the plate (23.2) has a cutout (23.7) allowing internal access to the mechanisms if necessary.

The lower part (23.1*c*) of the sides of the housing (23) extends forward to a considerable depth equivalent essentially to the width of the apparatus. The sides are provided with a plurality of holes in order to allow, on the one hand, positioning of the drum (4) associated with the cutting device, centering studs, rack device and, on the other hand, tensioning device (6) for feeding the strip of material and tensioning the latter. Advantageously, said lower part (23.1*a*) of the sides of the housing (23) has a cutout line (23.1*d*) in order to provide flexibility, on the one hand, for mounting tensioning device (6) and, above all, to allow slight deformation in order to match the movements to tension and press the paper against the drum (4).

The housing (23) also has a horizontal wall capable of directly accommodating a bow (12) of a gooseneck shape of the type described earlier and arranged in the middle part of the apparatus opposite the drum (4), making it possible to guide the pulled paper band.

Advantageously, the horizontal wall has, on the outer edge, a rounded longitudinal rim (23.9) to facilitate guiding the paper as it is ejected and located opposite a similar rounded longitudinal rim (8.4) formed on the cover in the lower part of the protective cover (8).

Drum (4) is a one-piece construction made of plastic and advantageously comprises a shaft (4.1) of which the ends (4.9), forming a finger, engage in the openings (23.10) made opposite them on the above-mentioned sides of the housing. This drum (4) comprises a small-diameter shaft (4.1) around which a plurality of evenly distributed, parallel discs (4.3) are arranged which are identified successively from right to left, making reference to the drawings, as (4.3.1, 4.3.2, 4.3.3, 4.3.4, 4.3.5, 4.3.6, 4.3.7), FIG. 2. The discs (4.3.2, 4.3.3, 4.3.4, 4.3.5, 4.3.6) have the same configuration and have shaped scalloping (4.4) around their periphery capable of constituting a recess for the blade holder (5) as will be described below. Disc (4.3.1) is solid and advantageously has a notch (4.3.1*a*) on its periphery, and is capable of controlling the rotational drive of the drum under the effect of tensioning device (6) which will be described below. Front end disc (4.3.1) also has a hole (4.3.7*b*) making it possible to engage and center one end of the shaft of the blade holder (5). Back end disc (4.3.7) is special in that it has an internal peripheral collar (4.10) located opposite adjacent intermediate disc (4.3.6), this collar (4.10) defining an opening or internal chamber (4.10.1) to accommodate rack device (7). This collar (4.10) also has a cut section (4.10.2) in the same plane as scalloping (4.4) which is used to accommodate the blade (5) in order to facilitate molding of the assembly, said cut section allowing, transversely over a given sector, internal access to the above-mentioned chamber (4.10.1) under the conditions stated below. Said chamber allows positioning of rack device (7) which is designed in the form of ring gear (7.2) which fits, with play, in said chamber. This ring gear (7.2) has two centering studs or projections on its outer edge, preferably of different diameter, which engage in the openings (23.11) made for this purpose on the internal side opposite the housing in order to ensure straightforward fitting and positional control. The other side of the ring gear (7.2) is shaped with a semicircular boss (7.3) that extends with a plurality of teeth (7.4) forming rack device (7). On the assembly of teeth that make up rack device (7), the first four teeth (7.4.*a*), FIG. 6, for example, have a constant profile, whereas the next three teeth (7.4.*b*), FIG. 6, have a progressive profile in order to subsequently initiate movements of the cutting blade. In a particularly advantageous way, the last tooth of the rack device (7) is higher than the others in order to allow the cutting blade to escape and allow satisfactory penetration into the paper band. The last tooth also provides, as will be explained below, a non-return means of limit stopping if the cutting blade jumps out of all the teeth (7.4) of the rack device (7) thus produced in order to follow the circumference of boss (7.3) with a view to a new operating cycle and present itself again to the first tooth formed on boss (7.3). This last higher tooth has another advantage in that it breaks the paper by directing the blade more deeply.

Referring to FIG. 1, blade holder (5) is a one-piece construction made of plastic and comprises a support rod (5.1) of which the ends form a finger (5.2), and which engage in the end discs of the above-mentioned drum (4). Teeth (5.3) of the cutting part forming blade holder (5) are made in one-piece with the support rod (5.1). These teeth (5.3) have a successive triangulation profile and have a non-smooth conformation which curves in a downward fashion in order to facilitate attacking the strip of paper material to be cut. As a result, the lower face of the teeth (5.3) are concave and capable of forming a seat (5.4), FIG. 4, and bearing area for that part of the material cut, as is shown in the drawings. Depending on the nature of the paper to be cut, the teeth of the blade are smooth or sawtooth.

Figure 6:
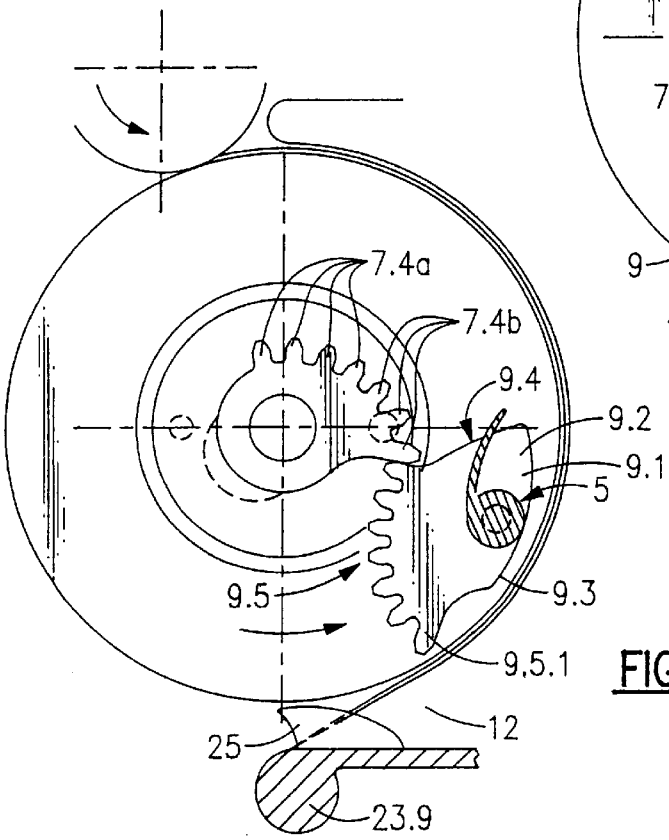
Figure 10:
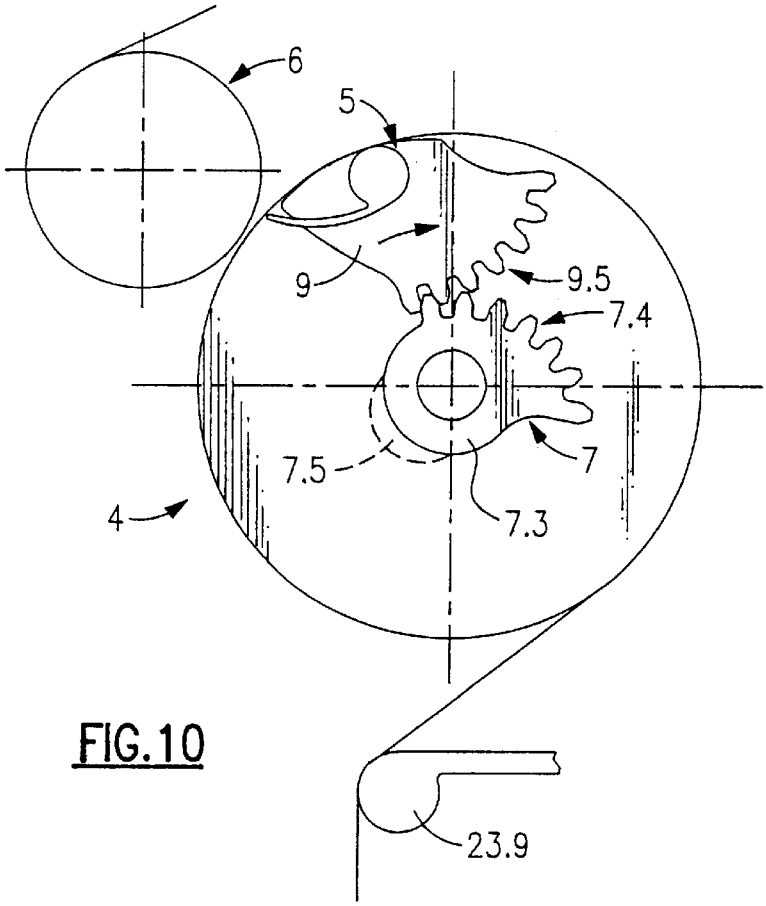

The end of the blade holder, which is capable of being opposite rack device (7), has a part forming a profiled heel (9). Referring for example to FIG. 6, the heel-shaped part (9) has a triangulated back part (9.1) with a rounded mating bracket (9.2) and two curved rims (9.3, 9.4) opening out to the widest part of said heel which is shaped with a plurality of teeth (9.5) forming rack device, said teeth being arranged gradually farther apart with respect to the axis of the blade, the leading tooth (9.5.1) being higher in order to ensure meshing.

The heel-shaped part (9) is connected to the shaft of the blade but in an off-center position so as to cause angular pivoting of the blade and of the part itself in a limited position. This pivoting makes it possible to accommodate the toothing of the blade inside the cavities formed on the intermediate discs of the drum in a maximum fallback position, said blade being in a plane below the generating line defined by the discs of the drum. The outer overhang of the teeth of the blade is limited by limit stopping the teeth with respect to said scalloping. As will be described below, the rack device formed on the heel associated with the blade is capable of cooperating with the fixed rack device and heel-shaped part (9) with a progressive tooth pattern, this gives displacement of the cutting blade at a progressive speed. The first meshing teeth correspond to the phase involving the highest force when the teeth of the blade penetrate the paper. Once the paper has been penetrated, cutting starts and the force becomes smaller. The cutting speed is accelerated by pulling the paper, and gearing down is increased by the fact that the teeth are larger and this allows faster cutting.

Figure 11:
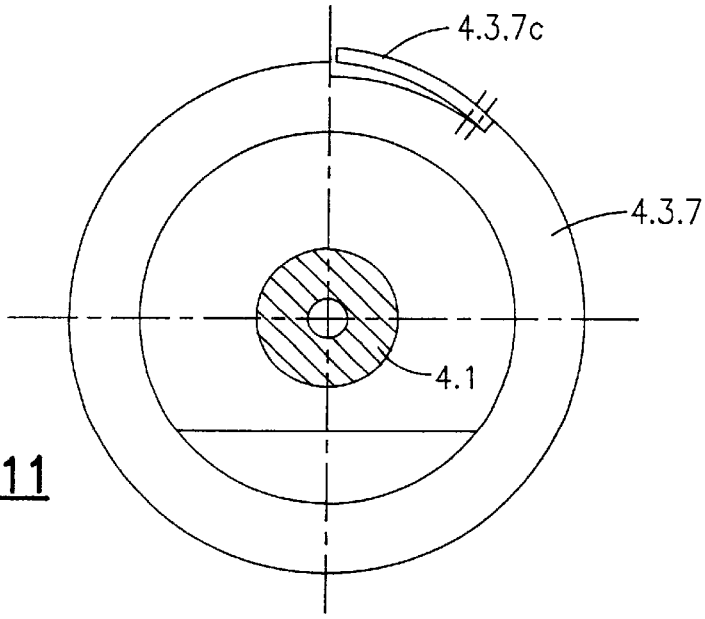
FIG. 11 is a profile view showing, in particular, the end disc formed on the drum with an additional non-return means of limit stopping.

FIG. 11 illustrates one advantageous embodiment in a profile view showing, in particular, end disc (4.3.7) formed on the drum (4) with a second means of additional non-return limit stopping (4.3.7*c*). Said means is formed during production of the disc (4.3.7) and is in the form of a flexible tongue that is free at one end, this tongue forming a cam and, due to resilience, slightly projecting beyond the periphery of the disc. This tongue is situated opposite the axis of rotation of the blade and is intended to catch against limit stop (25), FIG. 2, formed on the horizontal wall of the housing. Such an additional non-return limit stop is essentially useful in cases where, by manipulating the manipulator appropriately, the paper is torn before cutting. This could occur in the event of sharp, oblique pulling but does not correspond to normal use of the apparatus. If the cutting blade travels beyond, after rotation of the drum, tensioning device (6), non-return tongue (4.3.7*c*) is in front of limit stop (25), and in the event of backward rotation of the drum, the tongue comes into contact with above-mentioned limit stop, thus stopping rotation of the drum (4).

The tensioning device (6) which ensures feeding of the paper band to the drum and tensioning of the paper is now described.

As best seen in FIG. 1, this tensioning device (6) comprises a shaft (6.1) having, at each of its ends, centering fingers (6.3) that click in between the lateral sides (23.1*a*) of the housing (23) of the apparatus. On this shaft (6.1) there is a plurality of discs or washers (6.4), this assembly being a one-piece construction made of plastic. The number of discs or washers (6.4) equals twice the number of intermediate discs formed on the drum (4). Thus, after positioning and clicking in tensioning device (6), a certain number of discs (6.4*a*) will be in contact with the intermediate discs (4.3.2, 4.3.3, 4.3.4, 4.3.5, 4.3.6) formed on the drum (4), whereas the other intermediate discs (6.4*b*) will be situated in an intermediate plane between two discs formed on the drum. The assembly will contribute towards ensuring tensioning of the paper. As an alternative, shaft (6.1) may be solid or otherwise lightened.

Before describing the operation of the apparatus, it is appropriate to describe the particular additional means that have an effect on the positioning of the cutting blade holder (5) during rotation of the drum (4) by defining, for the latter, a very special trajectory. These two means are situated on the same side as the rack devices that control extension of the cutting blade.

The lower part of wall-mounted housing (23) has, on its horizontal wall, near the lateral side opposite the rack device (7), a shaped limit stop (25) with a curved profile forming a ramp against which heel-shaped part (9) associated with blade holder (5) and teeth mounting (9.5) of the rack device comes into contact. This limit stop (25) acts in order to initiate, after the cutting operation and unmeshing of the rack devices from each other, reintegration of the cutting blade (5) in the scalloping (4.4) formed on the intermediate discs (4.3) of the drum (4).

Figure 5:
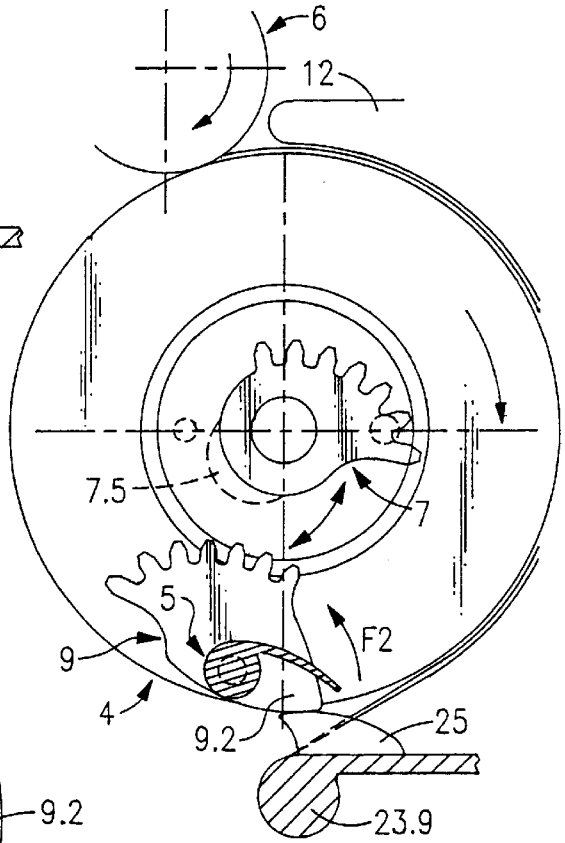

Due to its ramp-shaped profile, said limit stop (25) causes swivelling of the blade holder (5) in the direction of arrow (F2), FIG. 5, in a direction opposite to the direction of rotation of the drum (4) and causes its stowing in the above-mentioned scalloping (4.4).

Furthermore, an additional means is provided of controlling the position of the cutting blade (5) in the scalloping (4.4) formed on the drum (4) or alternately of ensuring locking of the cutting blade in position before a new operating cycle starts.

To achieve this and in a first application, there is, on tensioning device (6) ensuring control of rotation of the drum and pressure on the paper, an additional disc (26), FIG. 7, at the end of said means (6), situated in the plane of movement of the heel-shaped part (9) of the blade. This additional disc (26) has the function of acting as a limit stop and guide if, for any reason, the blade is in an extended position in relation to the scalloping on the drum (4) that accommodates it. Rotation of the drum (4) causes stopping of heel-shaped part (9) by one of its curved parts against the above-mentioned disc (26). Additional rotation of the drum (4) will cause, because of this, pivoting and swivelling downwards (arrow F3), FIG. 9, of the heel-shaped part (9) causing the blade to be retracted again in the scalloping formed on the drum, thus preventing the teeth of the blade from coming into contact with tensioning device (6). This special arrangement affords additional safety. Alternatively, boss (7.3), FIG. 1, formed on rack device (7) has an external offset (7.5), FIG. 5, that constitutes a means of limit stopping and blocking in position heel-shaped part (9) associated with the blade causing, during return travel of the blade holder, blocking of the latter in the scalloping (4.4) of the above-mentioned drum (4).

The lower part of the sides of protection cover (8) has openings allowing the cover to be clicked onto the sides of the mounting housing (23) by means of centering and positioning fingers or projections (27). The lower part of said housing (23) is also shaped with a wall capable of being opposite the bottom horizontal wall of the housing but leaving a space or slit to allow ejection of the paper from the apparatus. The front of the protective cover (8) has a vertical slit (8.5) through which the operating handwheel (6.5) of the tensioning device (6) can pass.

After the apparatus has been loaded with a reel of material mounted on the end fittings on the lateral sides (23.1*a*) of the housing (23), the apparatus is initially loaded. After initially opening the protective cover (8) by swivelling, the operator offers up the free end of the reel of material between tensioning device (6) and drum (4) and actuates, over a few degrees, the operating handwheel (6.5) in order to feed the strip of material between the drum and tensioning device (6) so that it emerges at the rear of the apparatus without, however, the latter clearing and emerging from the appropriate slit. The strip of material is tensioned by the plurality of discs (4.3, 6.4) formed on the drum and on tensioning device (6), respectively. One-piece gooseneck bow (12) formed on the housing (23) additionally ensures, if applicable, guiding of the paper. Having completed this initial loading operation, the cover (8) of the apparatus is refitted and the apparatus is ready for use. At this stage, the blade is completely accommodated in the scalloping (4.4) formed on the drum (4). The rack device formed on the blade does not yet mesh with the fixed-position rack device (7) accommodated in the chamber of the last disc of the drum (4).

The cutting operating phase is the next phase. The end of the paper band is still located inside the apparatus in an area corresponding to the rear of the drum (4) towards the gooseneck bow (12). The operator manually turns the operating handwheel (6.5) in the direction of arrow (F), FIG. 3, and this causes, by rotation of tensioning device (6), rotation, in a direction opposite to the drum (4), in the direction of the inside of the housing (23). At the start of the cycle, the blade is placed inside the scalloping (4.4) by leaving a space of a few millimeters with respect to the theoretical generating line formed by the intermediate discs (4.3) of the drum (4) before clearing. The start of rotation of the drum (4) causes, under the action of rack device (7) and heel-shaped part (9), displacement of the blade by several millimeters so that, when the first tooth of each of rack device (7) and heel-shaped part (9) has meshed, the last teeth are situated in the plane defined by the axis of the blade holder and the axis of the drum (4). In this situation, the cutting blade is located at the start of contact with the paper to be cut.

Progressive rotation makes it possible to present the first respective teeth formed on the rack device associated with the blade holder and the fixed rack device of the housing (23). The end of the strip of material emerges from the slit formed in the apparatus and can be gripped by the user. The latter then exerts a tensile force which causes rotation of the drum (4), thus ensuring continuity of the cutting operation. The cutting blade (5), due to meshing of the teeth of the two rack devices, is pivoted so that it is extended and slices the paper band following meshing of the teeth with a progressive profile. The teeth are extended at the rear of the apparatus and the strip of material will thus be gradually torn, the blade pivoting in the scalloping formed between the intermediate discs of the drum. Complete extensive of the blade corresponds to escape and meshing of the last two teeth of the rack devices with each other, the last tooth formed on the fixed rack device causing maximum extension of the cutting blade.

After unmeshing of the teeth of the rack devices from each other during an instant travel of rotation of the drum (4), the blade (5) remains in the "extended" position, the heel-shaped part (9) no longer being in contact with the disc which supports the fixed-position rack device.

Retraction of the blade holder (5) takes place by limit stopping and contact of that part of the blade that forms a heel with the fixed curved limit stop (25) on the bottom wall of the housing (23). This curved part forming a ramp causes, by a reverse swivelling effect, retraction of the blade into the scalloping (4.4) formed on the discs of the drum. Pivoting of the blade holder (5) causes, ipso facto, swivelling of the heel-shaped part (9), the latter being swivelled without coming into contact with the fixed-position disc of rack device (7). When the heel-shaped part (9) is in a situation where it escapes from the curved limit stop (25), the teeth of said heel-shaped part (9) are presented opposite the inlet area of the teeth formed on the fixed disc in readiness for a new operating cycle until the first teeth of the rack device start to mesh.

If, for any reason, the blade happens to be released from the scalloping (4.4) formed on the intermediate disc (4.3), causing the heel-shaped part (9) associated with the blade holder to protrude, continuous rotation of the drum (4) then causes contact of said heel-shaped part (9) with the limit-stop disc (26) formed at the end of tensioning device (6) which, in turn, causes the blade to be retracted and reinserted into its recess defined by the scalloping on the intermediate discs.

As an alternative, maintaining and blocking in position of the blade holder (5) in the scalloping in the second phase of the drum return operating cycle corresponding to the action of curved limit stop (25) are obtained by blocking said cutting blade using the additional shoulder formed on boss (7.3) which causes retention of the blade holder in the scalloping (4.4) of the drum (4). Release takes place when the heel-shaped part (9) associated with the blade holder resumes a new position to present its teeth to those formed on the rack device (7).

Operation of the assembly is therefore completely safe. The semiautomatic apparatus described comprises a limited number of parts, six as stated above, but each having multiple functions as is apparent from the description.

FIG. 7 is a schematic representation of the trajectory (T) of the cutting blade holder (5).

Figure 15:
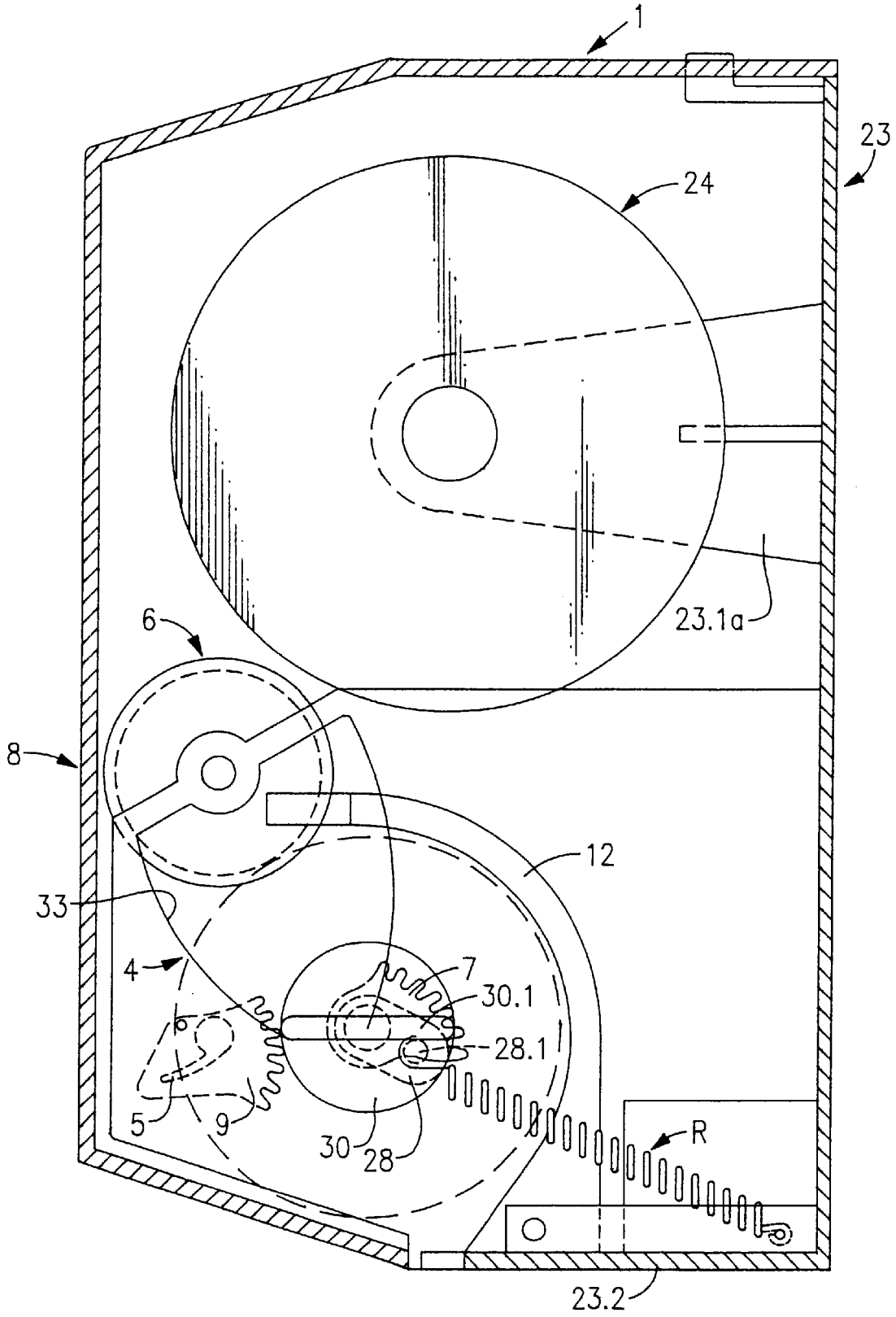
FIG. 15 is a schematic side view of the apparatus along the handwheel of the apparatus and shows the elastic mounting of the means of feeding the paper band.
Figure 16:
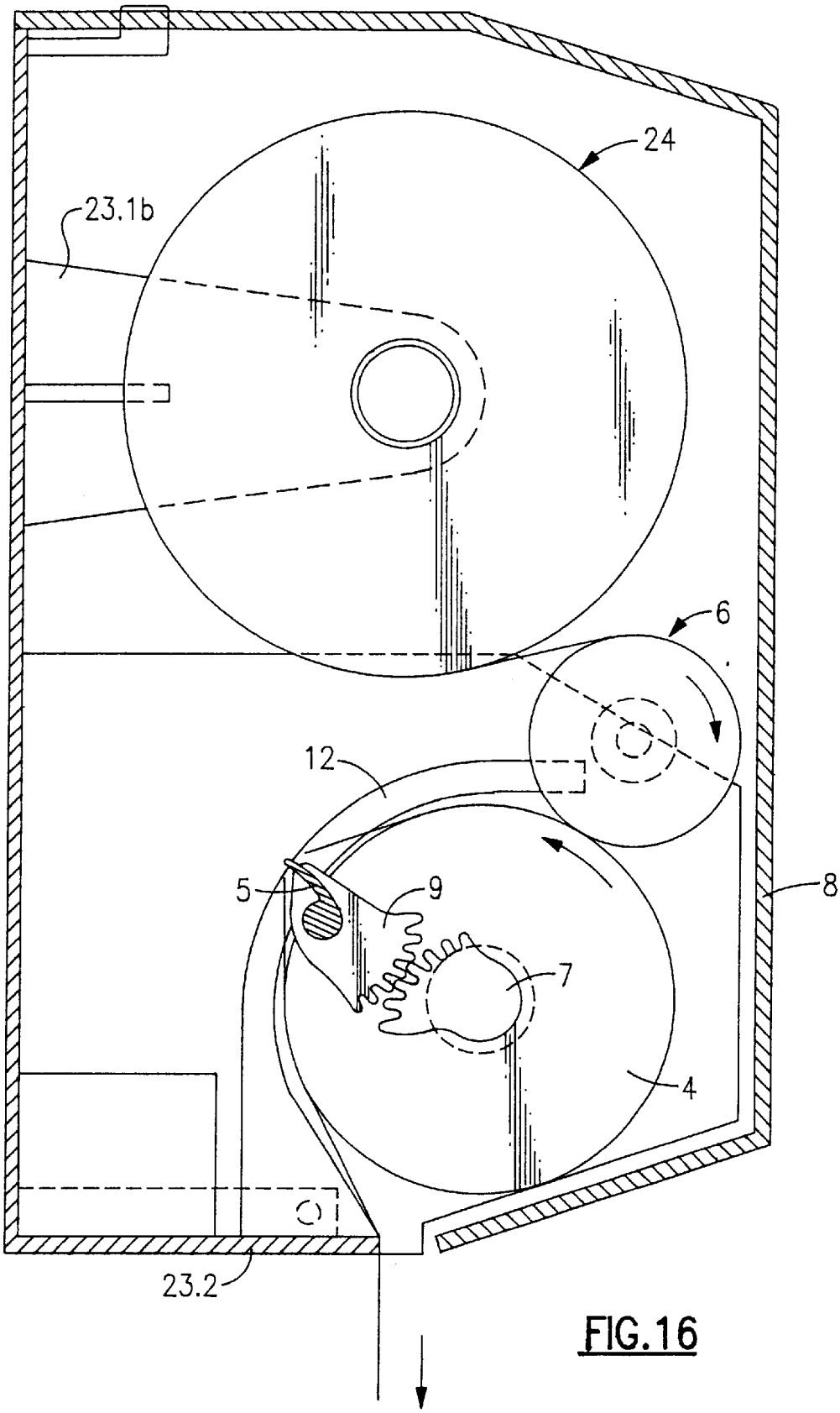
FIG. 16 is an axial cross-sectional view from the other side of the apparatus intended to show the operation of the cutting device.
Figure 17:
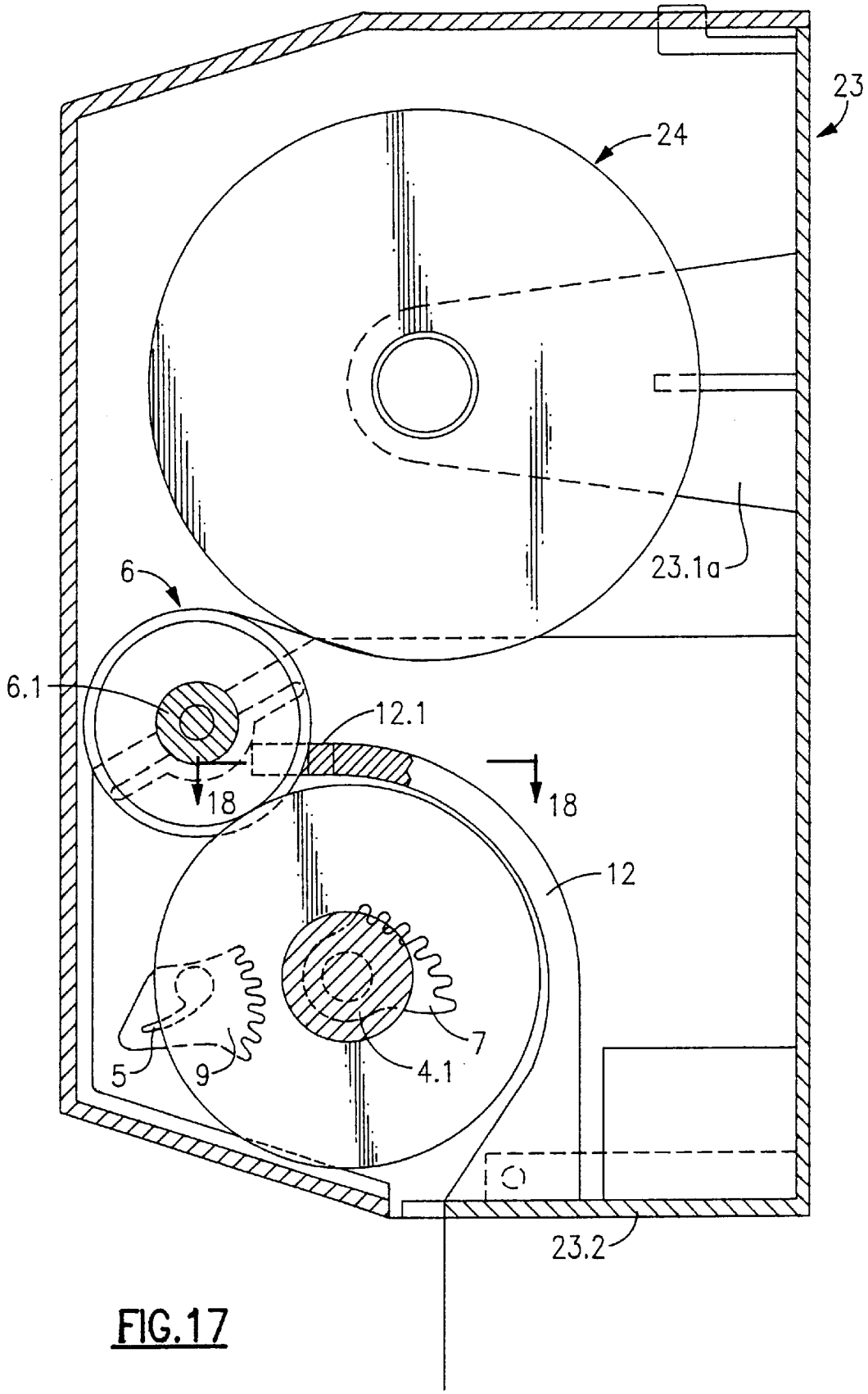
FIG. 17 is an axial cross-sectional view along line A—A in FIG. 14 from the middle part of the apparatus.
Figure 18:
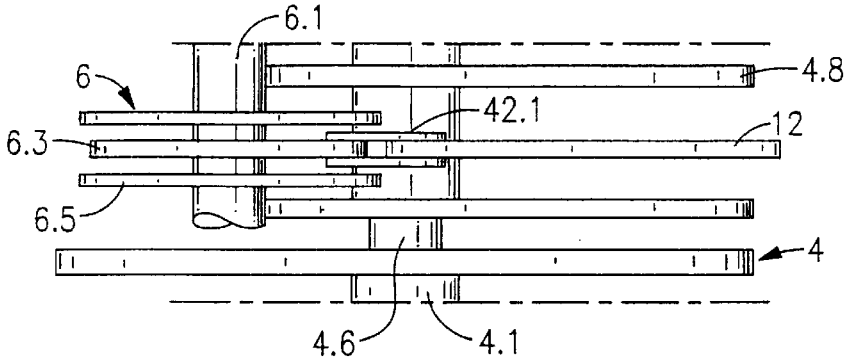
FIG. 18 is an axial cross-sectional view along line B—B in FIG. 17.
Figure 19:
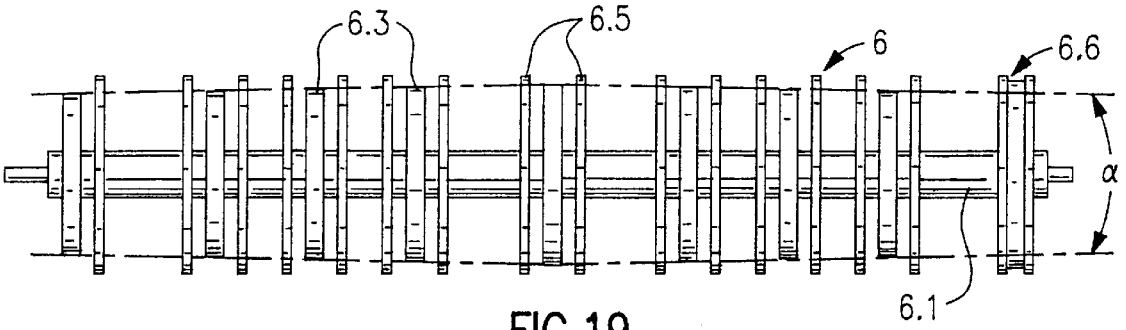
FIG. 19 is a large-scale view showing the means of feeding the paper band to the drum.

Also, the apparatus has, on the same side as the drive mechanism, an extension of the shaft of the drum (4) with a cam (28), FIG. 15, at its end of which the end comprises a finger (28.1), FIG. 15, capable of constituting a means of attaching a return spring (R) of which the other end is fixed to the wall-mounted housing (23).

Some details and descriptions of particular points are now also given.

Figure 12:
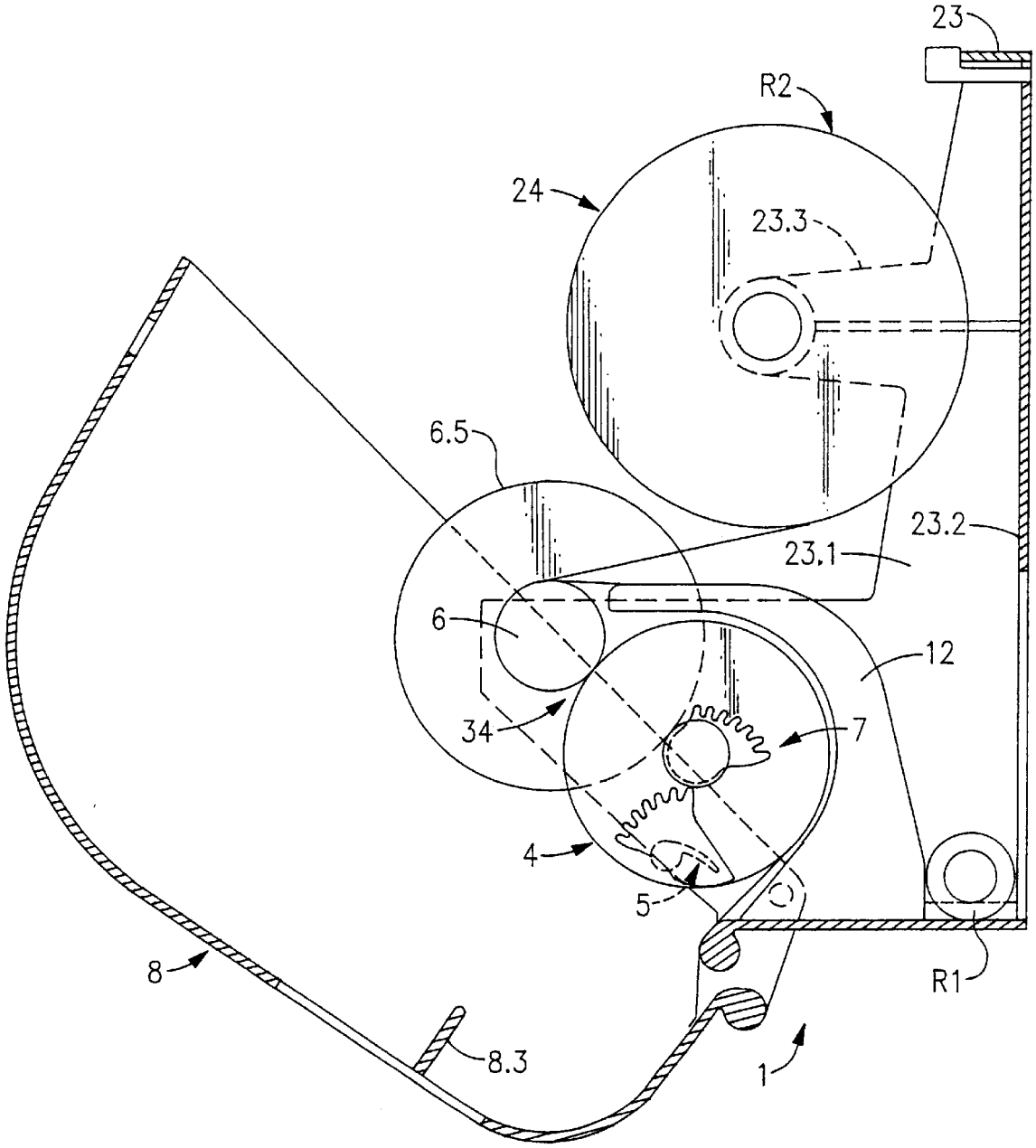
FIG. 12 is a schematic cross-sectional view of the apparatus showing the housing in its opened position.
Figure 13:
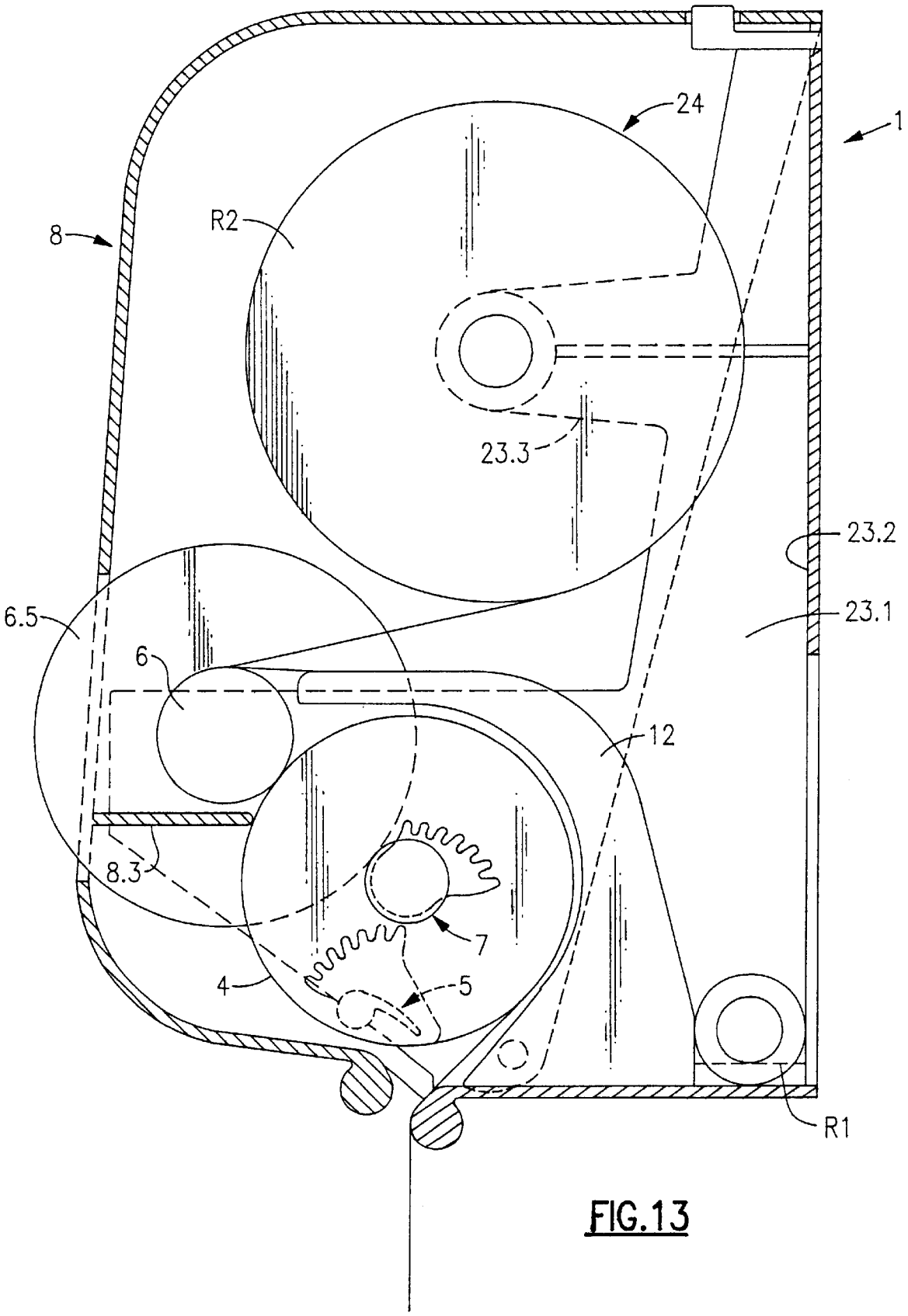
FIG. 13 is a view according to FIG. 12 with the housing in its closed position.

According to FIGS. 12 and 13 in the drawings, housing (23) is made with a hinged cover (8) of which the inside surface is made with a protruding projection (8.3) established in a perpendicular plane, said projection being placed horizontally at a level where it is opposite the area where the paper is gripped between the tensioning device (6) and the drum (4). The purpose of this projection (8.3) is to guide and present the first strip of material to be dispensed during loading in order to facilitate its insertion between tensioning device (6) and drum (4). Said projection (8.3) therefore just touches the space thus formed when the paper is inserted between tensioning device (6) and drum (4). This layout is particularly practical and involves no additional manufacturing cost when producing the cover.

In addition, provision is made to provide additional means allowing the simultaneous use of ends of reels of paper wipes whilst making it possible to fit a fresh reel in the upper part of the apparatus in order to avoid the apparatus (23)

becoming out of service when the reel of paper towels has been finished. For this purpose, as shown in FIG. 12 in the drawings, the horizontal bottom part (23.3) of the housing leaves a space behind the gooseneck-shaped part (12) in order to introduce means of positioning the reel of material (24) that is nearly finished. For this purpose, housing (23) has projections or bosses spaced in order to install the reel of material (24) that is nearly finished in an axial plane, and projections or bosses located either side of the gooseneck shaped part (12) capable of preventing its angular swivelling or pivoting. Such a layout makes it possible to preserve the ideal arrangement of reel (24) and satisfactory unreeling of ends of strips. The operator responsible for inspecting and commissioning the apparatuses can therefore, if the reel of material is nearly finished, very easily position the latter in the recess provided at the bottom of the housing (23) behind the gooseneck (12). The operator merely has to offer up the free end of the remaining paper band between tensioning device (6) and drum (4) in order to ensure final unreeling. At the same time, a new reel (R2) of material is positioned in the upper part of the apparatus and the end of the strip is inserted in the manner described above.

According to another particular feature, discs (6.3) of the tensioning device (6) are made with a diameter which decreases from the middle central disc onwards with an identical angulation a on each side. This reduction in the diameter of various discs (6.3) is obtained on a decreasing scale of several tenths of a millimeter of the diameter of consecutive discs. Tensioning device (6), which is clicked in between the lateral sides of the housing (23), can therefore be significantly bent during assembly, although the discs remain in relationship with each other and in contact with the drum. Moreover, drum (4) may itself, on its shaft between certain discs (4.3), be made with scalloping or weakened areas, preferably obtained by a reduction in diameter in order to give it a certain degree of flexibility in combination with that obtained by means (6) mentioned above. Thanks to these special measures, one obtains flexible mounting of tensioning device (6) on drum (4) and better tensioning of the paper prior to cutting it.

Moreover, some peripheral surfaces of discs (4.3) may be made with gripping areas.

Figure 20:
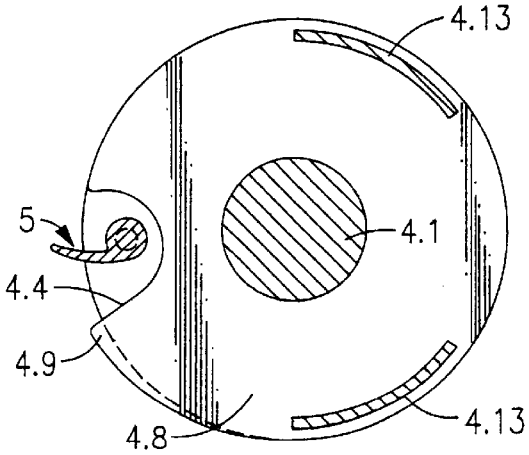
FIG. 20 is a cross-sectional view of the drum along line C—C. in FIG. 14.
Figure 21:
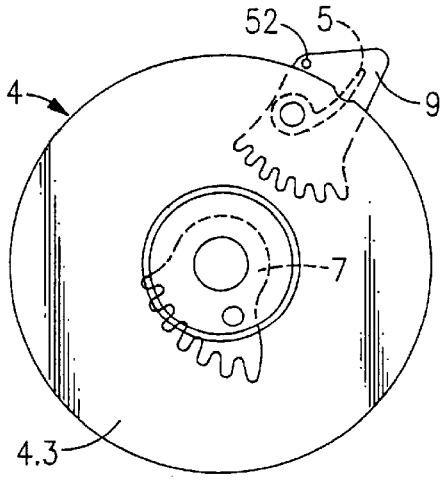
FIG. 21 is a side view of the drum showing, in particular, the anti-swivel means of limit stopping the gearing unit associated with the paper band take-off reel towards the drum.

According to another particular feature, the drum (4) is made with fabric or support surfaces (4.13) arranged between successive discs over the entire length of the drum. These fabric or support surfaces (4.13) are significantly recessed relative to the peripheral edge of the discs (4.3, 4.8). They are arranged as shown in FIG. 20, opposite the area for accommodating the paper cutoff device. Two pieces of fabric arranged behind the drum (4) are shown with a gap between them. The purpose of these fabric or support surfaces (4.13) is to prevent the paper from tearing inside the drum (4) and jamming if the user pulls the paper at an inappropriate angle and thus allow sliding of the material. These fabric or support surfaces (4.13) are preferably established over an angular sector of the order of 20 to 45°.

Figure 22:
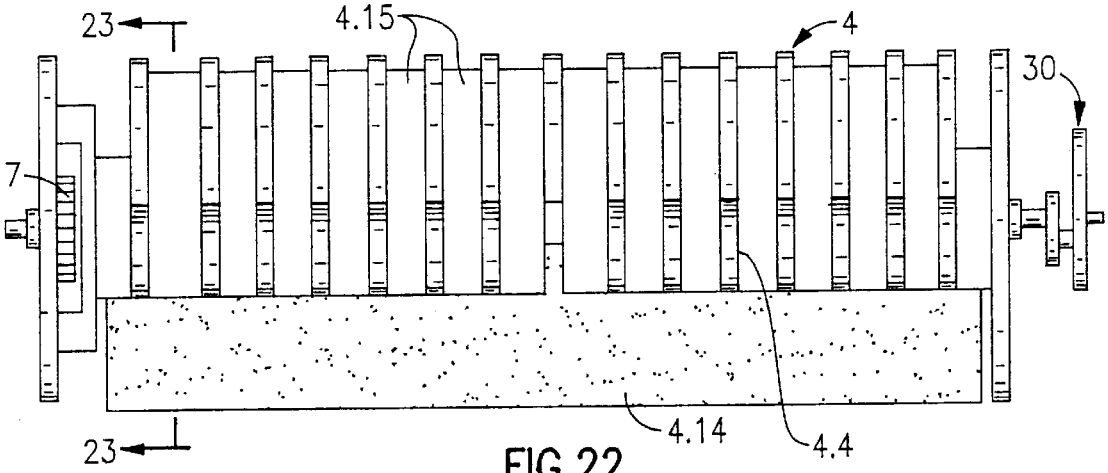
FIG. 22 is an alternative view of the drum of the apparatus.

According to another particular feature, as shown in FIGS. 15 and 22, drum (4) is made with all its components as a one-piece unit of an appropriate plastic and, more particularly, it also includes in its embodiment an operating handwheel (30) placed at the end on one side of the apparatus as well as an eccentric cam means described in the prior art making it possible, in combination with elastic return means (R), to actuate the drum (4). The operating handwheel (30) is, for example, established in the form of a disc with a central gripping rib (30.1) that can be actuated by the user in order to allow initial ejection of the strip of material before it is pulled by the user. To allow mounting of the drum thus produced in the body of the apparatus, the lateral side of the housing (23) is devised, as shown in FIG. 15, with a wide shaped hollow (33) allowing clearance for and mounting of the drum whilst providing and guaranteeing considerable flexible fixing of said drum and of the tensioning device (6) for tensioning and feeding the material.

According to another particular feature and improvement (FIG. 19), the end of the tensioning device (6) a large-width disc (6.6) with an internal throat (6.6.1) used to accommodate and guide disc (4.3) oppositely formed on the drum (4) and allowing driving of said tensioning device (6) under the effect of rotation of the drum.

Figure 14:
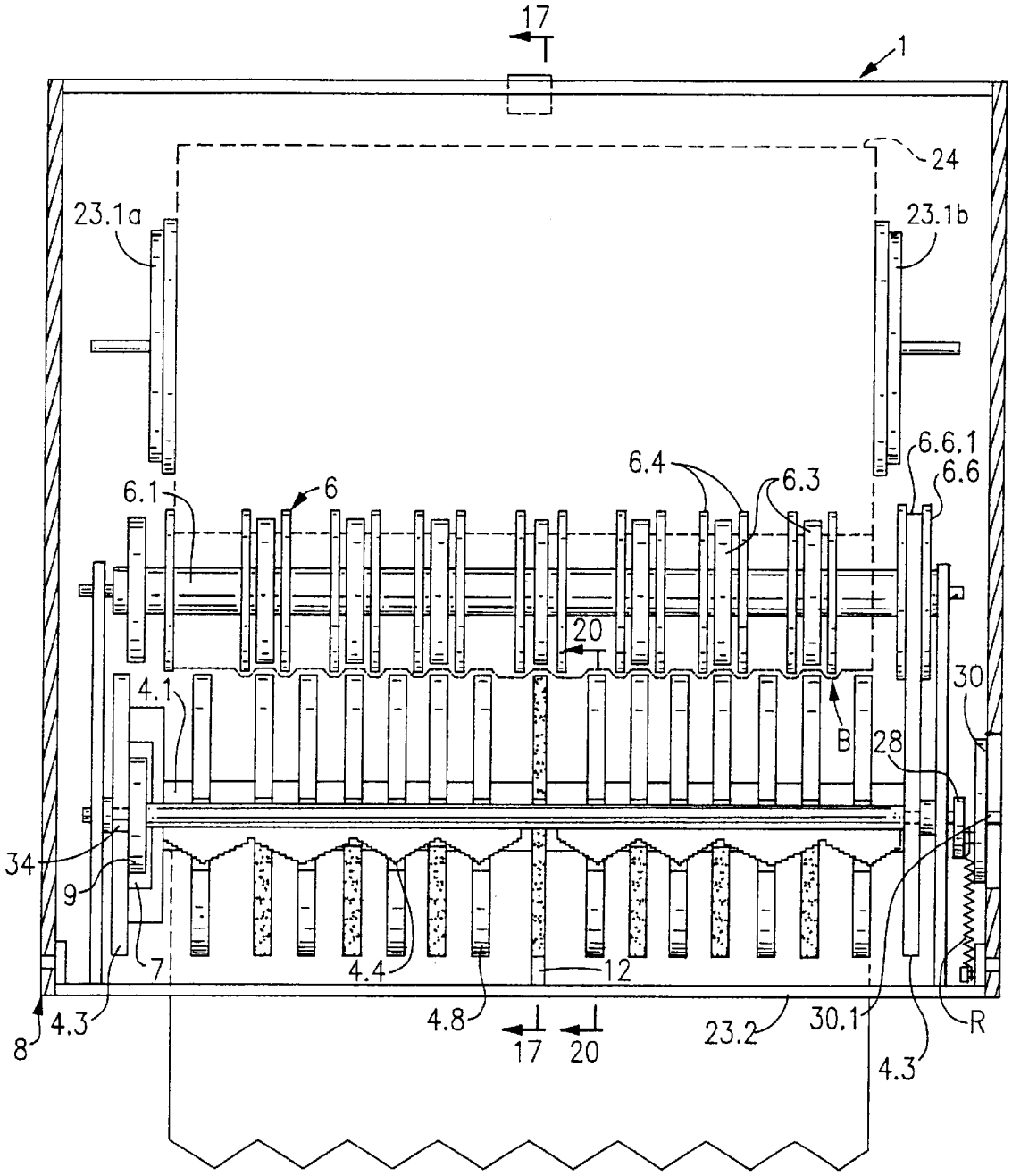
FIG. 14 is a plan view of the apparatus with the cover removed showing the special features of the drum and the pressure roller.

According to another particular feature and improvement, provision is made to place, on the toothed heel-shaped part (9) associated with the blade holder and cooperating with rack device (7), an anti-swivel limit stop (34), FIG. 14, to prevent the cutting blade from returning if the apparatus is incorrectly operated. This limit stop means is essentially produced in the form of a shaft or finger placed in the thickness of the heel-shaped part (9) that can come to a stop against the end disc (4.3) of the drum opposite the side of the housing.

Figure 23:
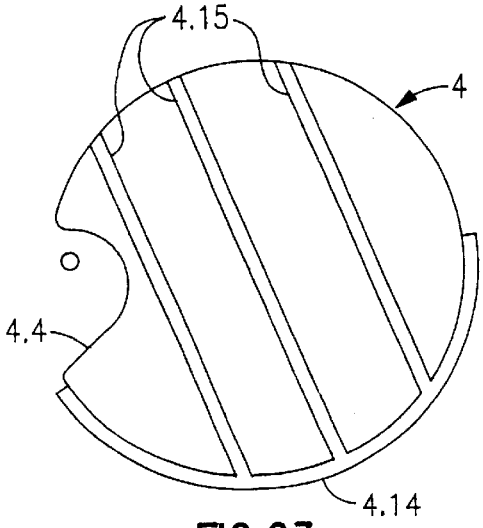
FIG. 23 is a cross-sectional view along line D—D in FIG. 22.
Figure 24:
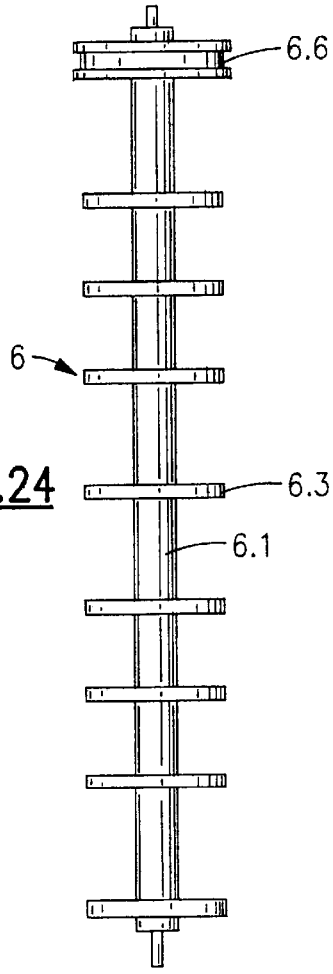
FIG. 24 is a view of the means of feeding the paper band in its configuration to cooperate with the drum shown in FIGS. 22 and 23.

According to another special feature and improvement of the drum in addition to the arrangements provided in FIG. 20 and shown in FIGS. 22 and 23, drum (4) is of one-piece construction and comprises, in particular, a smooth area (4.14) over essentially half the periphery of said drum, allowing sliding of the pulled paper or strip of material. This area (4.14) starts before the scalloping (4.4) that accommodates cutting blade holder (5). This area (4.14) has a diameter, in its curved mounting, that is essentially greater than discs (4.3) of the drum (4) so as to facilitate detachment of the strip of material after cutting. In this embodiment, the drum (4) is made with a plurality of discs (4.3) of identical diameter evenly distributed over the entire length of the drum, these discs being themselves spaced apart by several parallel plates (4.15) between them to ensure that the assembly is rigid. These plates, as shown in FIG. 23, are connected to the smooth area (4.14) at connection points, this bonding being obtained at the time of manufacture of the drum by thermoforming or injection molding. The number of spacer plates (4.15) varies according to requirements, and FIG. 23 shows three consecutive plates. The ends of the plates opposite the connecting point with the smooth area are shaped with a curved profile so that they are in intimate combination with the peripheral circumference of the drum. In this embodiment, the drum (4) has no central shaft. Its ends, as shown in FIG. 22, have other means allowing operating of the apparatus. Tensioning device (6), shown in FIG. 24, comprises a shaft (6.1) accommodating discs (6.3) of the above-mentioned type which cooperate with discs (4.3) formed on the drum. Discs (6.3) are of decreasing diameter starting from the middle disc as stated earlier. The use of this drum is particularly useful for certain types of strips of material, particularly certain highly elastic padded papers.

According to another particular feature, in order to reduce the operating noise of the apparatus, sound-absorbing retaining rings made of elastomer or equivalent material allowing silent operation of the apparatus may be fitted on some of the discs of the drum and/or of tensioning device (6) and, more particularly, in throat (6.6.1) of shaped disc (6.6).

The advantages of the invention will become apparent. The new concept of the apparatus, its quick assembly and suitability for automatic operation are emphasized.

I claim:

1. An automatic paper dispensing apparatus comprising:

a molded plastic housing;

a take-off reel of paper material supported in an upper part of said housing;

a hinged cutting blade for cutting a portion of paper material;

a support drum rotatably supported in a lower part of said housing;

a start mechanism associated with said support drum disposed on one side of said housing;

a pressure roller disposed in relation to said support drum which ensures feeding of a strip of paper from said take-off reel to the support drum and ensures tensioning of the strip of paper;

a rack gear internally fixed on one side of said plastic housing;

a toothed heel associated with a shaft of said hinged cutting blade and said rack gear for moving said cutting blade; and a protective cover hingably attached to said housing, said housing further including a pair of parallel end shields disposed in the lower part of said housing, each of said parallel end shields being perpendicular to a rear plane of said housing and spaced to allow positioning of said drum and said pressure component, each of said end shields including elastically deformable tongues having recesses to accommodate the pressure component and to position opposing ends of the support drum, wherein the support drum is a unitary member comprising a smooth continuous area extending over essentially one-half the outer periphery of the drum, said support drum including a plurality of discs spaced over the entire length thereof, each of said discs being spaced apart from one another by a plurality of parallel plates, each of said discs including scalloped areas for accommodating said cutting blades, said smooth area being disposed separately from the scalloped areas of the drum and in which the diameter of the drum at the smooth area is larger than the diameter of the drum at the remainder thereof so as to facilitate detachment of the strip of paper after cutting thereof.

* * * * *